US008301050B2

(12) United States Patent
Funatsu

(10) Patent No.: US 8,301,050 B2
(45) Date of Patent: Oct. 30, 2012

(54) IMAGE FORMING APPARATUS AND IMAGE FORMING SYSTEM

(75) Inventor: Kenichi Funatsu, Tokyo (JP)

(73) Assignee: Oki Data Corporation, Tokyo (JP)

( * ) Notice: Subject to any disclaimer, the term of this patent is extended or adjusted under 35 U.S.C. 154(b) by 386 days.

(21) Appl. No.: 12/360,389

(22) Filed: Jan. 27, 2009

(65) Prior Publication Data

US 2009/0196644 A1 Aug. 6, 2009

(30) Foreign Application Priority Data

Jan. 31, 2008 (JP) ..... 2008-021766

(51) Int. Cl.
*G03G 15/20* (2006.01)

(52) U.S. Cl. ..... 399/67; 399/69

(58) Field of Classification Search ..... 399/67, 399/69

See application file for complete search history.

(56) References Cited

U.S. PATENT DOCUMENTS

| | | | | |
|---|---|---|---|---|
| 5,049,906 | A * | 9/1991 | Kobayashi et al. | 399/67 X |
| 5,768,655 | A * | 6/1998 | Yoshino et al. | 399/69 |
| 6,381,422 | B1 * | 4/2002 | Tanaka | 399/69 |
| 7,120,370 | B2 * | 10/2006 | Watabe | 399/67 |

FOREIGN PATENT DOCUMENTS

| | | | |
|---|---|---|---|
| JP | 03061554 | A * | 3/1991 |
| JP | 05-046051 | A | 2/1993 |
| JP | 2002182503 | A | 6/2002 |
| JP | 2003173108 | A | 6/2003 |
| JP | 2003271010 | A | 9/2003 |
| JP | 2006-023329 | A | 1/2006 |

* cited by examiner

*Primary Examiner* — David Gray

*Assistant Examiner* — Erika J Villaluna

(74) *Attorney, Agent, or Firm* — Panitch Schwarze Belisario & Nadel LLP

(57) ABSTRACT

An image forming apparatus having a fixing unit fixing a developer image formed based on image data received onto a medium includes a target fixing temperature determination unit, a fixable temperature range computing unit, and a fixing temperature control unit. The target fixing temperature determination unit determines fixing temperature arranged based on the medium as target fixing temperature. The fixable temperature range computing unit computes a fixing temperature range fixable the developer image on the medium by using medium information of the medium while using the target fixing temperature as reference temperature. The fixing temperature control unit controls the fixing unit based on the fixable temperature range computed by the fixable temperature range computing unit.

30 Claims, 20 Drawing Sheets

| MEDIUM THICKNESS ( μm) | PRINTABLE UPPER LIMIT TEMP. OFFSET VALUE Toff1(°C) | PRINTABLE LOWER LIMIT TEMP. OFFSET VALUE Toff2(°C) |
|---|---|---|
| ABOVE 300 | +12 | −3 |
| 300 | +12 | −3 |
| 290 | +12 | −3 |
| 280 | +12 | −4 |
| 270 | +12 | −4 |
| 260 | +12 | −4 |
| 250 | +12 | −4 |
| : | : | : |
| 110 | +5 | −10 |
| 100 | +5 | −10 |
| 90 | +4 | −11 |
| 80 | +4 | −11 |
| 70 | +4 | −11 |
| 60 | +4 | −12 |
| BELOW 60 | +4 | −12 |

FIG. 4

| ADDED IMAGE DENSITY(%) | PRINTABLE UPPER LIMIT TEMP. OFFSET VALUE Toff1(°C) | PRINTABLE LOWER LIMIT TEMP. OFFSET VALUE Toff2(°C) |
|---|---|---|
| 300 | +3 | −3 |
| 290 | +3 | −3 |
| 280 | +3 | −3 |
| 270 | +3 | −4 |
| 260 | +3 | −4 |
| 250 | +3 | −4 |
| 240 | +4 | −4 |
| : | : | : |
| 60 | +10 | −13 |
| 50 | +10 | −13 |
| 40 | +11 | −14 |
| 30 | +11 | −14 |
| 20 | +12 | −15 |
| 10 | +12 | −15 |
| 0 | +30 | −30 |

FIG. 10

| MEDIUM THICKNESS(μm) | PRINTABLE UPPER LIMIT TEMP. OFFSET VALUE Toff1(°C) | PRINTABLE LOWER LIMIT TEMP. OFFSET VALUE Toff2(°C) |
|---|---|---|
| ABOVE 300 | +12 | −3 |
| 300 | +12 | −3 |
| 290 | +12 | −3 |
| 280 | +12 | −4 |
| 270 | +12 | −4 |
| 260 | +12 | −4 |
| 250 | +12 | −4 |
| : | : | : |
| 110 | +5 | −10 |
| 100 | +5 | −10 |
| 90 | +4 | −11 |
| 80 | +4 | −11 |
| 70 | +4 | −11 |
| 60 | +4 | −12 |
| BELOW 60 | +4 | −12 |

FIG. 15

| MEDIUM CLASS | PRINTABLE UPPER LIMIT TEMP. OFFSET VALUE Toff1(°C) | PRINTABLE LOWER LIMIT TEMP. OFFSET VALUE Toff2(°C) |
|---|---|---|
| PLAIN SHEET | +10 | −13 |
| GLOSSY SHEET | +5 | −6 |
| LABEL SHEET | +5 | −6 |
| POSTCARD | +3 | −4 |
| ENVELOP | +3 | −4 |
| OHP | +3 | −3 |

IMAGE FORMING APPARATUS AND IMAGE FORMING SYSTEM

BACKGROUND OF THE INVENTION

1. Field of the Invention

The present invention relates to an image forming apparatus having a fixing temperature control function and an image forming system having the image forming apparatus.

2. Description of Related Art

Generally, a related art image forming apparatus employing an electrophotographic method includes a fixing unit fixing a developer image formed on a surface of an image carrier such as a photosensitive drum onto a recording medium. Such a fixing unit includes a heat roller having a heating element and a pressure roller disposed pressed against the heat roller. When the recording medium having the developer image transferred thereon passes between the heat roller and the pressure roller, the heat and pressure is applied, thereby fixing the developer image onto the recording medium.

The related art image forming apparatus having such a fixing unit usually includes a fixing temperature control function controlling fixing temperature by monitoring surface temperature of the heat roller. For example, Japanese Unexamined Patent Application Publication No. H05-46051 discloses a prior art image forming apparatus including a timer mechanism arranging a time between a time at which surface temperature of the heat roller reaches a prescribed temperature and a time at which outer circumference surface temperature of the pressure roller becomes uniformalized.

In the image forming apparatus having the fixing temperature control function described above, however, the fixing temperature to begin fixing operation is fixed so as to secure image quality of the image to be fixed onto the recording medium, and the fixing operation halts until the surface temperature of the heat roller reaches the prescribed fixing temperature. Consequently, for example, in a case of beginning printing operation immediately after the image forming apparatus is activated, the print operation does not begin until the heat roller reaches the prescribed fixing temperature, causing prolongation of a time period until completion of printing. Since the fixing temperature to begin the fixing operation is inflexible, appropriate fixing temperature corresponding to image data or the recording medium cannot be selected, causing difficulty in image quality enhancement.

The present invention provides an image forming apparatus capable of adjusting a time period until fixing temperature reaches an appropriate level to begin fixing operation according to image data or a recording medium. Moreover, the present invention provides the image forming apparatus capable of obtaining fixing stability and enhancing fixing quality by such an adjustment of the fixing temperature to the appropriate level to begin the fixing operation.

BRIEF SUMMARY OF THE INVENTION

According to one aspect of the invention, an image forming apparatus having a fixing unit fixing a developer image formed based on image data received onto a medium includes: a target fixing temperature determination unit determining fixing temperature arranged based on the medium as target fixing temperature; a fixable temperature range computing unit computing a fixing temperature range fixable the developer image on the medium by using medium information of the medium while using the target fixing temperature as reference temperature; and a fixing temperature control unit controlling the fixing unit based on the fixable temperature range computed by the fixable temperature range computing unit.

According to another aspect of the present invention, an image forming system includes an image processing apparatus processing image data and an image forming apparatus having a fixing unit fixing a developer image formed based on the image data received from the image processing apparatus onto a medium. The image forming apparatus includes: a communication unit communicating with the image processing apparatus; a target fixing temperature determination unit determining fixing temperature arranged based on the medium as target fixing temperature; a fixable temperature range computing unit computing a fixing temperature range fixable the developer image on the medium by using medium information of the medium while using the target fixing temperature as reference temperature; and a fixing temperature control unit controlling the fixing unit based on the fixable temperature range computed by the fixable temperature range computing unit.

Additional features and advantages of the present invention will be more fully apparent from the following detailed description of embodiments, the accompanying drawings and the associated claims.

BRIEF DESCRIPTION OF THE DRAWINGS

A more complete appreciation of the aspects of the invention and many of the attendant advantage thereof will be readily obtained as the same becomes better understood by reference to the following detailed description when considered in connection with the accompanying drawings, wherein:

FIG. 4 is a schematic diagram illustrating a fixable temperature range offset table;

FIG. 10 is a schematic diagram illustrating a fixable temperature range offset table;

FIG. 15 is a schematic diagram illustrating a fixable temperature range offset table;

DETAILED DESCRIPTION OF PREFERRED EMBODIMENTS

Figure 1:
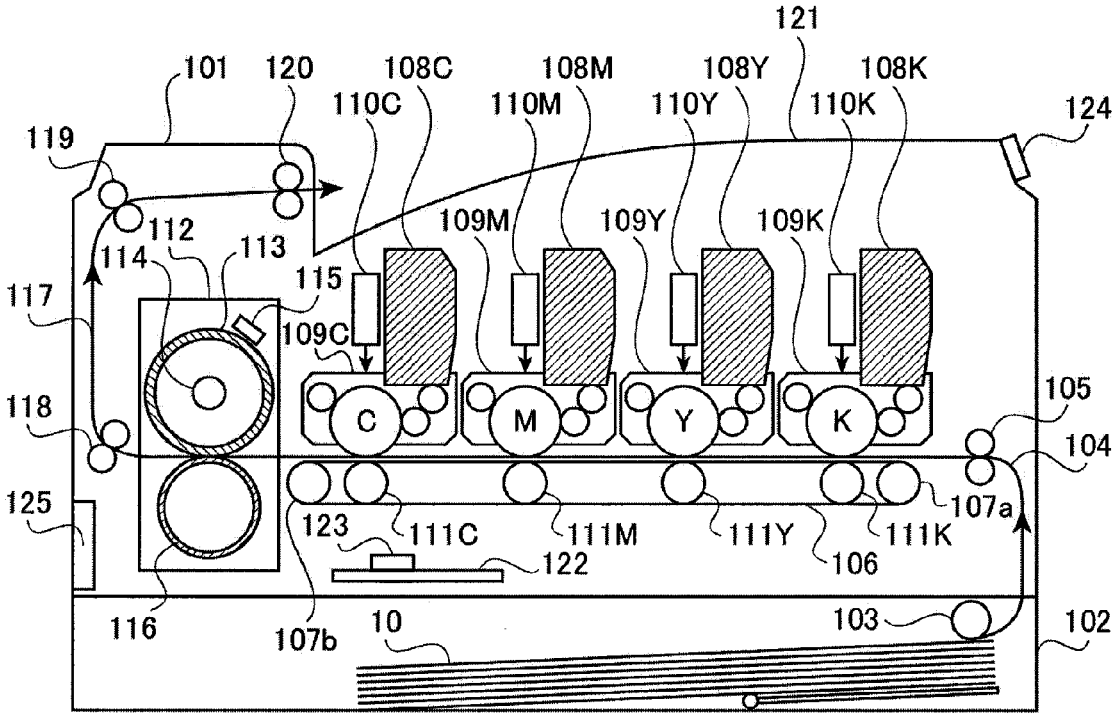
FIG. 1 is a schematic diagram illustrating an image forming apparatus according to a first embodiment of the present invention.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, like reference numerals designate identical or corresponding parts throughout the several views.

First Embodiment

Referring to FIG. 1, an image forming apparatus 101 employing an electrophotographic method according to a first embodiment of the present invention is illustrated. The image forming apparatus 101 includes a fixing unit 112 fixing a developer image formed on a surface of an image carrier, for example, a photosensitive drum 109, onto a recording medium. The image forming apparatus 101 of the present invention is now described in detail.

The image forming apparatus 101 includes: a sheet cassette 102 storing a sheet or sheets 10 serving as the recording medium or recording media; a feed roller 103 separately conveying the sheet 10 sheet by sheet from the sheet cassette 102; a conveyance path 104 guiding conveyance of the sheet 10 fed from the feed roller 103; a conveyance roller 105 conveying the sheet 10 to a conveyance belt 106; the conveyance belt 106 conveying the sheet 10 in a course of image forming by an image forming unit 108; a driven roller 107*a* and a drive roller 107*b* tightly stretching the conveyance belt 106; the image forming unit 108 forming the developer image with the electrophotographic method; a print head unit 110 forming an electrostatic latent image on a surface of the photosensitive drum 109 included in the image forming unit 108 with light; a transfer roller 111 transferring the developer image formed on the surface of the photosensitive drum 109 to the sheet 10; the fixing unit 112 fixing the developer image transferred to the sheet 10 with application of heat and pressure; a conveyance path 117 guiding conveyance of the sheet 10 conveyed by the conveyance roller 106; conveyance rollers 118 and 119 conveying the sheet 10 in a sheet ejection direction; an ejection roller 120 ejecting the sheet 10; a stacker 121 stacking the sheet 10 ejected thereon; a control board 122 controlling the image forming apparatus 101; a nonvolatile memory 123 storing a control program and the like of the image forming apparatus 101; an operator panel 124 receiving a print setting provided by a user; and an interface connector 125 transmitting and receiving print data and the like.

The sheet cassette 102 serving as a box member includes an opening at an upper surface thereof, so that a plurality of sheets 10 on which the images to be formed are accumulated therein, and each of the plural sheets 10 is fed from the opening by the feed roller 103.

The sheet cassette 102 includes the feed roller 103 disposed in such a manner as to contact the sheet 10 of the sheet cassette 102. The feed roller 103 is made up of at least a roller pair and separates the plural sheets 10 sheet by sheet by rotation thereof rotated by power transmitted from a drive system (not shown), thereby supplying the sheet 10 to the conveyance path 104.

The conveyance path 104 serving as a guide member guides the sheet 10 supplied from the sheet cassette 10 to the conveyance roller 105. The conveyance roller 105 made up of a roller pair is disposed at an end of the conveyance path 104. The conveyance roller 105 conveys the sheet 10 guided along the conveyance path 104 to the conveyance belt 106.

The conveyance belt 106 serving as an endless belt member is disposed in such a manner as to contact the photosensitive drum 109 with certain pressure. The conveyance belt 106 is tightly stretched by the driven roller 107*a* and the drive roller 107*b* disposed at each end thereof. The driven roller 107*a* and the drive roller 107*b* support the conveyance belt 106 with certain tension. The driven roller 107*a* and the drive roller 107*b* are rotated by power transmitted from a drive system (not shown), thereby operating the conveyance belt 106.

The image forming unit 108 includes, for example, the photosensitive drum 109, and forms the developer image corresponding to each color of black, yellow, magenta, and cyan by a developer image forming mechanism developing the electrostatic latent image formed on the photosensitive drum 109. Such four colors of black, yellow, magenta, and cyan are abbreviated as K, Y, M, and C, respectively. Each of image forming units 108K, 108Y, 108M, and 108C is disposed above the conveyance belt 106, and is disposed in sequence from an upper stream in a conveyance direction of the sheet 10. Each of the image forming units 108K, 108Y, 108M, and 108C is substantially similar to one another except for the color. A description of the image forming units 108K, 108Y, 108M, and 108C is hereafter given by using the image forming unit 108 as representative of the image forming units 108K, 108Y, 108M, and 108C.

The photosensitive drum 109 can store an electrical charge on the surface thereof and serves as an image carrier forming the electrostatic latent image thereon by the light irradiated from the print head unit 110 (described later). The photosensitive drum 109 is a drum member rotatable around a central axis thereof, and is disposed in such a manner as to contact the conveyance belt 106 in a lowest portion of the image forming unit 108.

The print head unit 110 includes a light-emitting element such as light-emitting diode (LED) and is disposed above the photosensitive drum 109. The print head unit 110 allows the light-emitting element to emit the light based on the image data received, thereby exposing the electrostatic latent image on the surface of photosensitive drum 109.

The transfer roller 111 is disposed in a position face to face with the photosensitive drum 109 through the conveyance belt 106. When the sheet 10 passes between the photosensitive drum 109 and the conveyance belt 106, high voltage is applied to the transfer roller 111 from a power source (not shown), thereby transferring the developer image formed by the image forming unit 108 to the sheet 10.

The fixing unit 112 includes the heat roller 113 rotatable around a central axis thereof and the pressure roller 116 disposed in such a manner as to press against the heat roller 113. The heat roller 113 includes a core metal, made of metal such as aluminum or iron, having a halogen lamp 114 serving as a heating member inside, and includes an elastic member, for example, silicone rubber, on a surface thereof. The surface of elastic member is coated by a coating layer or a tube having substantially the same function as the coating layer so as to secure separatability with the developer image transferred on the sheet 10.

The temperature sensor 115 serving as a non-contact thermistor, for example, is disposed a certain space away from the surface of the heat roller 113. The temperature sensor 115 measures surface temperature of the heat roller 113. The halogen lamp 114 is turned on and off according to an execution result of a control program based on the temperature measured by the temperature sensor 115, so that the surface temperature of the heat roller 113 is controlled.

The pressure roller 116 is disposed in such a manner as to contact the surface of the heat roller 113 with certain pressure applied by a tension spring (not shown). Consequently, the pressure roller 116 and the heat roller 113 contact each other with the certain pressure, thereby forming a nip portion in which the heat and pressure is applied to the sheet 10.

The conveyance path 117 serving as a guide member guides the sheet 10 conveyed from the conveyance belt 106 to the ejection roller 120. Each of the conveyance rollers 118, 119 is made up of a roller pair and is disposed in a mid-stream of the conveyance path 117. The conveyance rollers 118, 119 convey the sheet 10 guided along the conveyance path 117 to the ejection roller 120.

The ejection roller 120 made up of a roller pair is disposed at an end of the conveyance path 117. The ejection roller 120 ejects the sheet 10 guided along the conveyance path 117 to the stacker 121. The stacker 121 is disposed on a downstream side of the ejection roller 120 and stacks thereon the sheet 10 ejected from the ejection roller 120.

The control board 122 serving as a board member includes a central processing unit (CPU, not shown) or the nonvolatile memory 123 thereon. The CPU included on the control board 122 executes the control program stored in the nonvolatile memory 123, thereby controlling the image forming apparatus 101.

The nonvolatile memory 123 includes a memory such as a flash memory, an ultra violet erasable programmable read only memory (UV-EPROM), or an electronically erasable and programmable read only memory (EEPROM), and stores the control program and the like of the image forming apparatus 101.

The operator panel 124 includes a display mechanism, for example, a liquid crystal display (LCD), and an input mechanism, for example, a switch or switches. The operator panel 124 is disposed at an upper portion of the image forming apparatus 101 to facilitate input operation by the user. The operator panel 124 displays a printing progress state or an apparatus state of the image forming apparatus 101 and receives the print setting from the user.

The interface connector 125 serving as an interface connector connects with a local area network (LAN) or a universal serial bus (USB) cable.

In the printing operation of the above structure of the image forming apparatus 101, the CPU on the control board 122 reads the control program stored in the nonvolatile memory 123 upon receiving the print data through the interface connector 125 after receiving the input of the print setting by the user through the operation panel 124.

The CPU supplies operation instructions to the drive system (not shown) and the power source system (not shown) based on the control program read. Upon receiving the operation instructions, the drive system transmits drive power to each of the rollers, and the power source system begins initial operation to apply the high voltage.

The feed roller 103 begins to rotate by the drive power transmitted from the drive system, and separately conveys the plural sheets 10 sheet by sheet from the sheet cassette 102. Each of the sheets 10 conveyed from the feed roller 103 is guided along the conveyance path 104, and is conveyed to the conveyance roller 105 which conveys the sheet 10 to the conveyance belt 106. The conveyance belt 106 is driven by rotation of the driven roller 107*a* and the drive roller 107*b*, and conveys the sheet 10 to a position in contact with the photosensitive drum 109.

Herein, the print head unit 110 is driven based on the print data received and forms the electrostatic latent image on the photosensitive drum 109. The image forming unit 108 develops the electrostatic latent image formed on the photosensitive drum 109 using the developer image forming mechanism. When the sheet 10 is conveyed between the photosensitive drum 109 and the conveyance belt 106, the developer image is transferred on the sheet 10 by the transfer roller 111 applied with the high voltage by the power source system (not shown).

The sheet 10 having the developer image transferred thereon is conveyed to the fixing unit 112 by drive of the conveyance belt 106. In the fixing unit 112, the heat roller 113 is controlled in such manner as to have appropriate fixing temperature according to the execution result of the control program based on the temperature measured by the temperature sensor 115. Upon reading the fixing unit 112, the sheet 10 is applied with the heat and pressure, thereby fixing the developer image thereon.

The sheet 10 having the developer image fixed thereon is conveyed along the conveyance path 117 to the ejection roller 120 by rotation of the conveyance rollers 118 and 119. The sheet 10 conveyed to the ejection roller 120 is ejected to the stacker 121 by rotation of the ejection roller 120.

Figure 2:
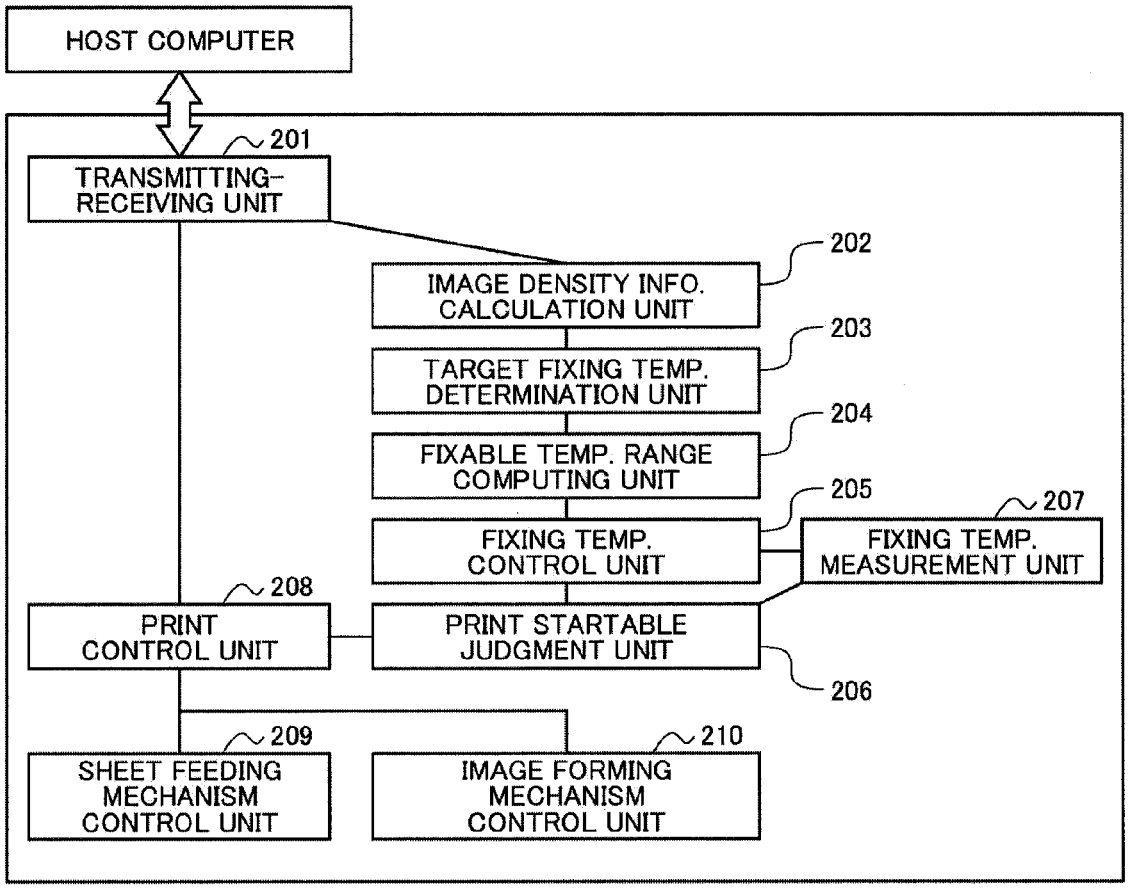
FIG. 2 is a block diagram illustrating a control program.

Referring to FIG. 2, a description of the control program executed by the CPU is given. The control program allows the print operation of the image forming apparatus 101 to be executable.

The control program includes: a transmitting-receiving unit 201 transmitting and receiving print data to and from a host computer and the like through the interface connector 125; an image density information calculation unit 202 calculating image density information per prescribed region of the print data received; a target fixing temperature determination unit 203 determining fixing temperature arranged based on the sheet 10 as target fixing temperature; a fixable temperature range computing unit 204 computing a fixing temperature range in which the developer image can be fixed onto the sheet 10 by using the image density information while using the target fixing temperature as reference temperature; a fixing temperature control unit 205 controlling surface temperature of the heat roller 113 based on the fixable temperature range; a print startable judgment unit 206 judging whether or not to start the print operation based on the surface temperature of the heat roller 113; a fixing temperature measurement unit 207 acquiring a measurement result of the surface temperature of the heat roller 113 measured by the temperature sensor 115; a print control unit 208 controlling the print operation as a whole of the image forming apparatus 101; a sheet feeding mechanism control unit 209 controlling feeding of the sheet 10; and an image forming mechanism control unit 210 controlling image formation and a transfer process.

The transmitting-receiving unit 201 transmits and receives the print data to and from the host computer and the like through the interface connector 125. Upon receiving the print data, the transmitting-receiving unit 201 notifies the image density information calculation unit 202 of reception of the print data.

Figure 3A:
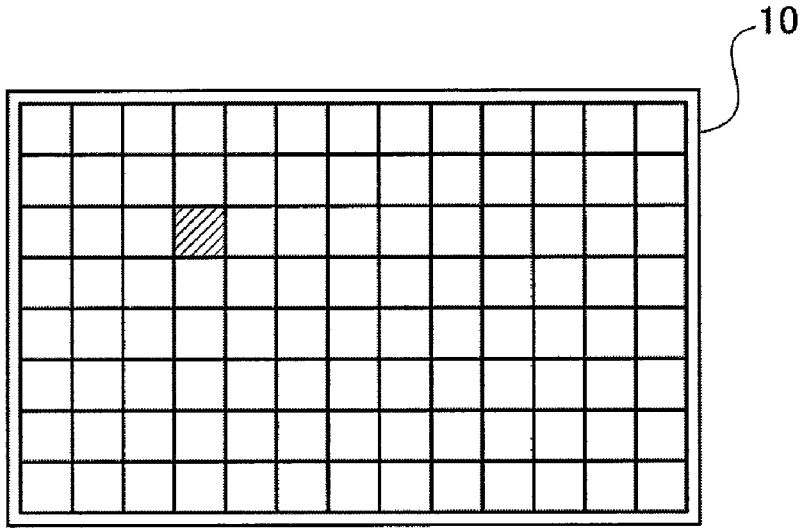
FIG. 3A is a schematic diagram illustrating a calculation method of image density information.
Figure 3B:
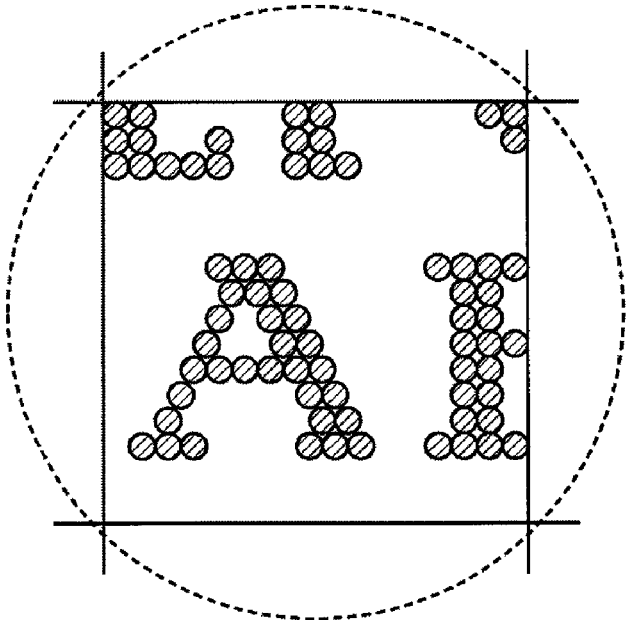
FIG. 3B is an enlarged view illustrating the calculation method of the image density information of FIG. 3A.

The image density information calculation unit 202, for example, partitions the print data to be formed on the sheet 10 into cells as illustrated in FIG. 3A and determines a number of data dots in a cell unit of a prescribed region as illustrated in FIG. 3B. The image density information calculation unit 202 calculates the image density by dividing the number of data dots with respect to each cell determined by a number of all dots occupied in the cell. In a case where the image to be formed on the sheet 10 is a multi-color image, three colors such as cyan, magenta, and yellow are used for general color expression. Therefore, the image density information calculation unit 202 calculates the image density with respect to each color, and eventually calculates a sum of the image density of the three colors (hereafter referred to as added image density).

Since each maximum image density of the cyan, magenta, and yellow is one hundred (100) percent, the added image density of the three colors becomes three hundred (300) percents. However, each maximum image density of the three colors may be reduced to a value below one hundred (100) percent due to a problem of fixability, for example. Therefore, it must be noted that the added image density is not necessarily three hundred (300) percents.

The target fixing temperature determination unit 203 determines the fixing temperature arranged associated with thickness information of the sheet 10 as the target fixing temperature (hereafter referred to as "Tprint"). In the first embodiment, the fixing temperature serving as the reference temperature is arranged beforehand according to the thickness of the sheet 10 to be used for printing, so that a good printing result is obtained in a case where the printing operation is performed with the added image density of three hundred (300) percents. The target fixing temperature determination unit 203 determines the temperature of "Tprint" based on the thickness of the sheet 10 used for the printing. For example, where the thickness of the sheet 10 is one hundred twenty (120) μm, the target fixing temperature determination unit 203 determines the temperature of "Tprint" to be one hundred eighty (180) degrees Celsius.

The fixable temperature range computation unit 204 computes the fixing temperature range in which the developer image can be fixed on the sheet 10 by using the added image density calculated by the image density information calculation unit 202 while using the temperature of "Tprint" determined by the target temperature determination unit 203 as the reference temperature. Herein, a portion having higher added image density uses a larger quantity of the developer, causing an increase in a heat amount to be removed by the developer. Therefore, the fixable temperature range computing unit 204 computes the fixable temperature range using the highest added image density among the added image density calculated by the image density information calculation unit 202.

Particularly, the fixable temperature range computing unit 204 computes the fixable temperature range using a fixable temperature range offset table as illustrated in FIG. 4. For example, where the sheet 10 to be used for the printing has a thickness of one hundred twenty (120) μm, where the target fixing temperature determination unit 203 determines the temperature of"Tprint" to be one hundred eighty (180) degrees Celsius, and where the added image density calculated by the image density information calculation unit 202 is two hundred fifty (250) percents, the fixable temperature range computing unit 204 refers to the fixable temperature range offset table and computes upper limit temperature (hereafter referred to as "Tupper") in the fixable temperature range to be one hundred eighty three (183) degrees Celsius ("Trpint" of 180° C.+an upper limit temperature offset value "Toff1" of 3° C.=183° C.) and lower limit temperature (hereafter referred to as "Tlower") in the fixable temperature range to be one hundred seventy six (176) degrees Celsius ("Trpint" of 180° C.+a lower limit temperature offset value "Toff2" of −4° C.=176° C.).

The fixing temperature control unit 205 controls the surface temperature of the heat roller 113 by turning on and off the halogen lamp 114 based on the fixable temperature range computed by the fixable temperature range computing unit 204.

The print starable judgment unit 206 judges whether or not to start the print operation based on the measurement result of the surface temperature of the heat roller 113.

The fixing temperature measurement unit 207 acquires, based on an instruction of the fixing temperature control unit 205 or the print startable judgment unit 206, the measurement result of the surface temperature of the heat roller 113 measured by the temperature sensor 115. The acquired surface temperature of the heat roller 113 is notified to the fixing temperature control unit 205 or the print startable judgment unit 206.

Where the print startable judgment unit 206 judges that the print operation is startable, the print control unit 208 controls the print operation of the image forming apparatus 101 as a whole.

The sheet feeding mechanism control unit 209 controls the feeding of the sheet 10 fed by the feed roller 103 and the like based on the control by the print control unit 208.

The image forming mechanism control unit 210 controls the image formation provided by the image forming unit 108 and the transfer process provided by the transfer roller 111 and the like based on the control by the print control unit 208.

Figure 5:
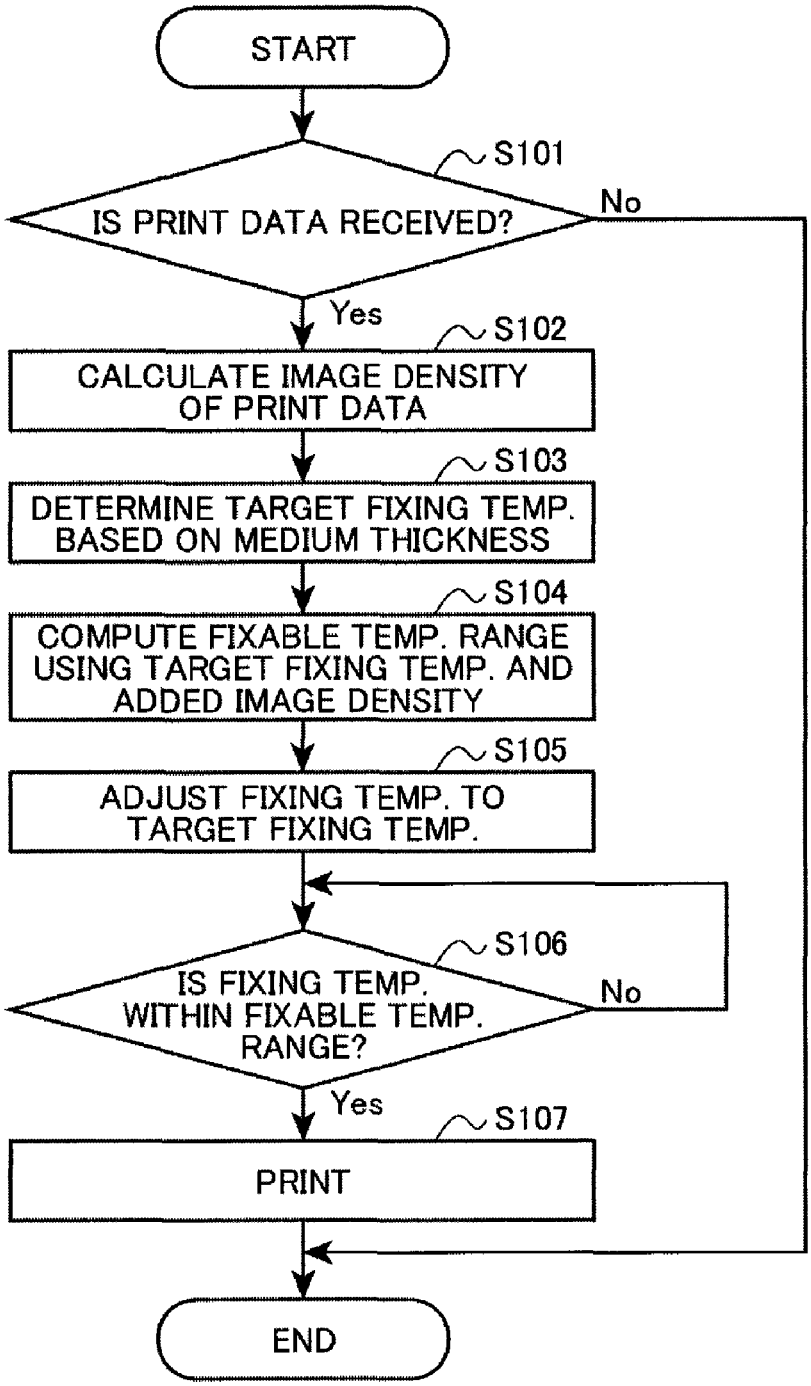
FIG. 5 is a flowchart illustrating an example procedure based on the control program.

Referring to a flowchart of FIG. 5, an example procedure based the control program described above is illustrated.

When the print data are transmitted with respect to image forming apparatus 101 from the host computer, the transmitting-receiving unit 201 receives the print data through the interface connector 125. The transmitting-receiving unit 201 notifies of reception of the print data with respect to the image density information calculation unit 202 (Yes in step S101). Upon receiving the notification, the image density information calculation unit 202 calculates the image density of the print data received (step S102). Herein, the image density information calculation unit 202 is assumed to calculate the added image density of the portion having the highest image density within a print page.

In step S103, the target fixing temperature determination unit 203 determines the temperature of "Tprint" based on the thickness of the sheet 10.

Subsequently, the fixable temperature range computing unit 204 computes the temperature of "Tupper" and "Tlower" by using the added image density calculated by the image density information calculation unit 202 while using the temperature of "Tprint" determined by the target fixing temperature determination unit 203 as the reference temperature (step S104).

In step S105, the fixing temperature control unit 205 supplies the instruction with respect to the fixing temperature measurement unit 207 to measure the surface temperature of the heat roller 113 by the temperature sensor 115. Where the surface temperature of the heat roller 113 is below "Tprint" as a result of measurement thereof by the temperature sensor 115, the fixing temperature control unit 205 supplies the instruction to the power source system (not shown) to distribute the power to the halogen lamp 114 such that the surface temperature of the heat roller 113 is adjusted to the temperature of "Tprint." Upon receiving the instruction from the fixing temperature control unit 205, the power source system begins the power distribution to the halogen lamp 114.

On the other hand, where the surface temperature of the heat roller 113 is above "Tprint" as a result of measurement thereof by the temperature sensor 115, the fixing temperature control unit 205 does not supply the power distribution instruction to the power source system (not shown).

After the surface temperature of the heat roller 113 reaches the temperature of "Tprint," the fixing temperature control unit 205 controls the power source system (not shown) such that the surface temperature of the heat roller 113 remains at the temperature of "Tprint."

Next, the print startable judgment unit 206 supplies the instruction with respect to the fixing temperature measurement unit 207 to measure the surface temperature of the heat roller 113 by the temperature sensor 115. Where the surface temperature of the heat roller 113 is within the fixable temperature range as a result of measurement thereof by the temperature sensor 115 (Yes in step S106), the print startable judgment unit 206 supplies a print start instruction to the print control unit 208. Upon receiving the print start instruction, the print control unit 208 supplies print execution instructions to the sheet feeding mechanism control unit 209 and the image forming mechanism control unit 210. Upon receiving the print execution instruction from the print control unit 208, the sheet feeding mechanism control unit 209 allows the feed roller 103 and the like to start conveying the sheet 10. The image forming unit 108 and the transfer roller 111 instructed by the image forming mechanism control unit 210 form the developer image on the sheet 10 conveyed.

The fixing unit 112 fixes the developer image on the sheet 10. Subsequently, the sheet 10 having the developer image fixed thereon is guided along the conveyance path 118 and is conveyed to the ejection roller 120. The ejection roller 120 ejects the sheet 10 on the stacker 121 (step S107).

Where the surface temperature of the heat roller 113 is outside the fixable temperature range as a result of measurement thereof by the temperature sensor 115 (No in step S106), the print startable judgment unit 206 does not supply the print start instruction to the print control unit 208. The print startable judgment unit 206 is on standby until the surface temperature of the heat roller 113 reaches within the fixable temperature range. Where the surface temperature of the heat roller 113 reaches within the fixable temperature range, the print startable judgment unit 206 supplies the print start instruction to the print control unit 208.

Now, an adjustment of a print startable timing made by the operation based on the control program is described in detail in comparison with a prior art apparatus.

A description of adjusting the print startable timing in a course of heating the fixing unit 112 is given below.

A time "t" consumed by the fixing unit 112 to be heated by turning on the halogen lamp 114 is expressed in Formula 1 as follows:

$$t=(T1-T\text{room})/h, \qquad \text{Formula 1:}$$

where "h" is a rate of heat temperature change, "Troom" is room temperature, and "T1" is print start temperature.

Figure 6A:
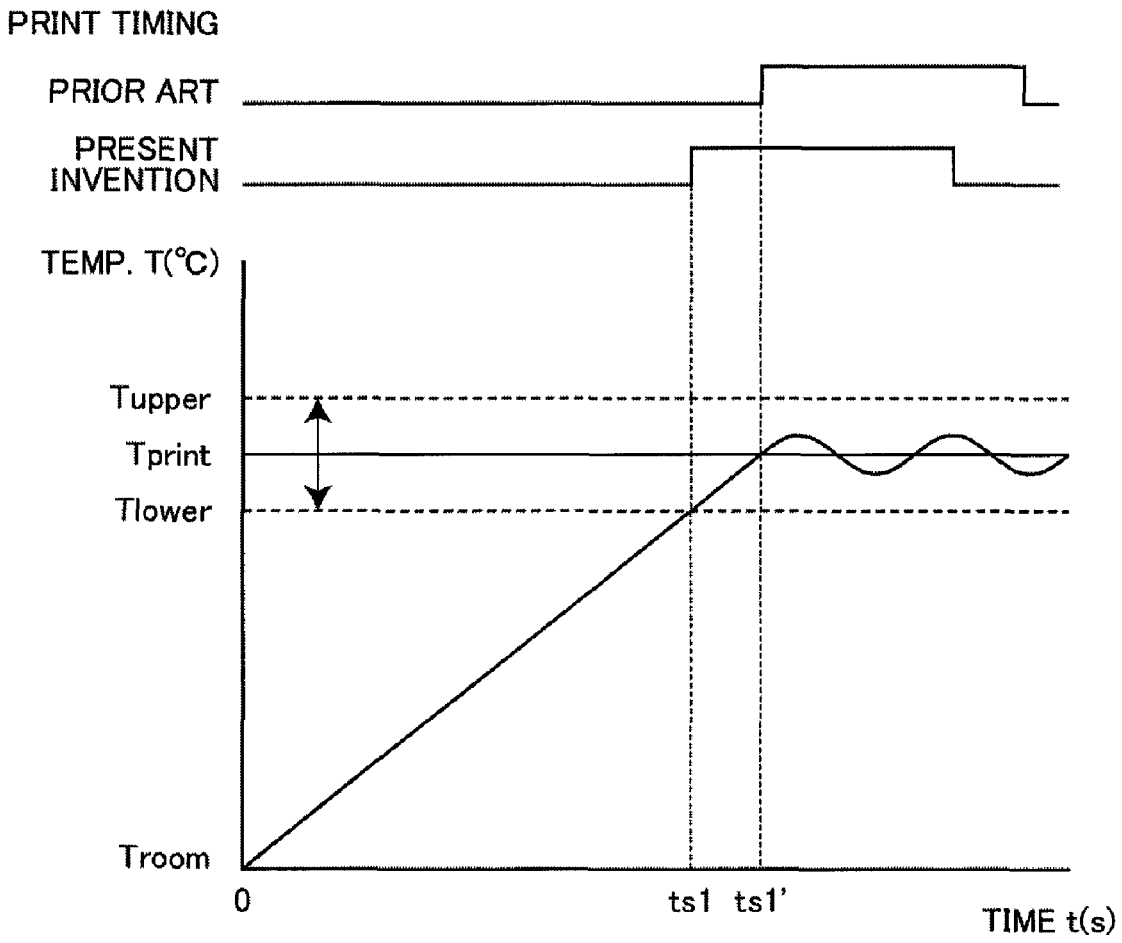
FIG. 6A is a schematic diagram illustrating a print startable timing.

As illustrated in FIG. 6A, a time "ts1" consumed by the image forming apparatus 101 of the first embodiment until the printing operation is started is fifty eight (58) seconds according to Formula 1 above.

$$ts1=(170-25)/2.5=58 \text{ seconds},$$

where the print start temperature, that is, the lower limit temperature within the fixable temperature range "Tlower" is one hundred seventy (170) degrees Celsius, the rate of the heat temperature change "h" is two-point-five degrees Celsius per second (2.5° C./sec), and the room temperature "Troom" is twenty five (25) degrees Celsius. A double-headed arrow in FIG. 6A indicates a print startable temperature range according to the present invention.

On the other hand, a time "ts1" consumed by the prior art apparatus until the printing operation is started is sixty two (62) seconds according to Formula 1.

$$ts1'=(180-25)/2.5=62 \text{ seconds},$$

where the print start temperature, that is, the target fixing temperature "Tprint" is one hundred eighty (180) degrees Celsius, the rate of the heat temperature change "h" is two-point-five degrees Celsius per second (2.5° C./sec), and the room temperature "Troom" is twenty five (25) degrees Celsius.

Therefore, according to the image forming apparatus 101 of the first embodiment, the printing operation can be started four (4) seconds (62 sec−58 sec) earlier than the prior art apparatus.

Next, a description of adjusting the print startable timing in a course of releasing the heat from the fixing unit 112 is given. In a case where the temperature of the fixing unit 112 once increases to a high level, for example, after successive printing, the fixing unit 112 accumulates the heat therein, causing an increase in difficulty of decreasing the temperature thereof. Consequently, a temperature change of the fixing unit 112 in a course of releasing the heat is moderate compared to a temperature change in a course of heating the fixing unit 112.

A time "tt" consumed by the fixing unit 112 to release the heat is expressed in Formula 2 as follows:

$$tt=(T0-T1)/r, \qquad \text{Formula 2:}$$

where "r" is a rate of releasing temperature change, "T0" is temperature of the fixing unit 112 at the present time, and "T1" is print start temperature.

Figure 6B:
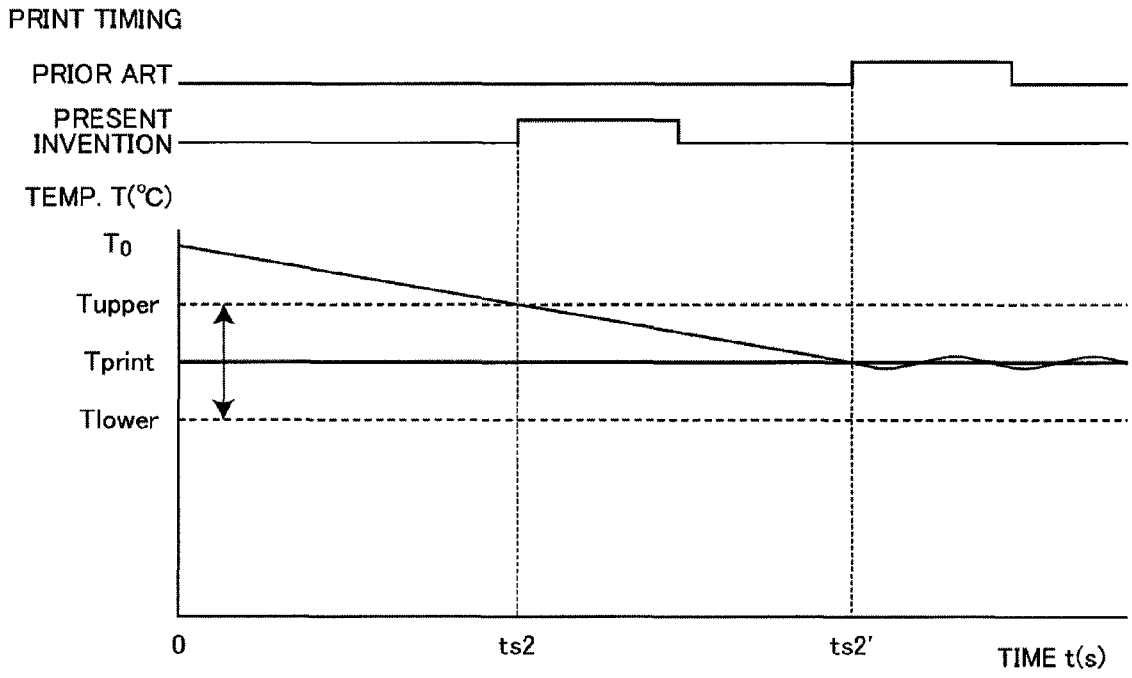
FIG. 6B is another schematic diagram illustrating a print startable timing.

As illustrated in FIG. 6B, a time "ts2" consumed by the image forming apparatus 101 of the first embodiment until the printing operation is started is fifty (50) seconds according to Formula 2 above.

$$ts2=(200-190)/0.2=50 \text{ seconds},$$

where the print start temperature, that is, the upper limit temperature within the fixable temperature range "Tupper" is one hundred ninety (190) degrees Celsius, the rate of the releasing temperature change "r" is zero-point-two degrees Celsius per second (0.2° C./sec), and the temperature "T0" of the fixing unit 112 at the present time is twenty hundred (200) degrees Celsius. A double-headed arrow in FIG. 6B indicates a print startable temperature range according to the present invention.

On the other hand, a time "ts2" consumed by the prior art apparatus until the printing operation is started is one hundred (100) seconds according to Formula 2.

$$ts2'=(200-180)/0.2=100 \text{ seconds},$$

where the print start temperature, that is, the target fixing temperature "Tprint" is one hundred eighty (180) degrees Celsius, the rate of the releasing temperature change "r" is zero-point-two degrees Celsius per second (0.2° C./sec), and the temperature "T0" of the fixing unit 112 at the present time is two hundred (200) degrees Celsius.

Therefore, according to the image forming apparatus 101 of the first embodiment, the printing operation can be started fifty (50) seconds earlier than the prior art apparatus.

In addition to the above advantage over the prior art apparatus, the fixing temperature range computing unit 204 according to the first embodiment refers to the fixable temperature range offset table as illustrated in FIG. 4 and computes the fixable temperature range based on the added image density calculated by the image density information calculation unit 202. Therefore, for example, where the sheet 10 to be used for the printing has the thickness of one hundred twenty (120) μm, where the target fixing temperature determination unit 203 determines the temperature of "Tprint" to be one hundred eighty (180) degrees Celsius, and where the added image density calculated by the image density information calculation unit 202 is two hundred fifty (250) percents, the fixable temperature range computing unit 204 computes the upper limit temperature "Tupper" in the fixable temperature range to be one hundred eighty three (183) degrees Celsius and the lower limit temperature "Tlower" in the fixable temperature range to be one hundred seventy six (176) degree Celsius (that is, the fixable temperature range is between 176° C. and 183° C.). Moreover, for example, where the sheet 10 to be used for the printing has the thickness of one hundred twenty (120) μm, where the target fixing temperature determination unit 203 determines the temperature of "Tprint" to be one hundred eighty (180) degrees Celsius, and where the added image density calculated by the image density information calculation unit 202 is fifty (50) percent, the fixable temperature range computing unit 204 computes the upper limit temperature "Tupper" in the fixable temperature range to be one hundred ninety (190) degrees Celsius and the lower limit temperature "Tlower" in the fixable temperature range to be one hundred sixty seven (167) degree Celsius (that is, the fixable temperature range is between 167° C. and 190° C.).

Figure 7A:
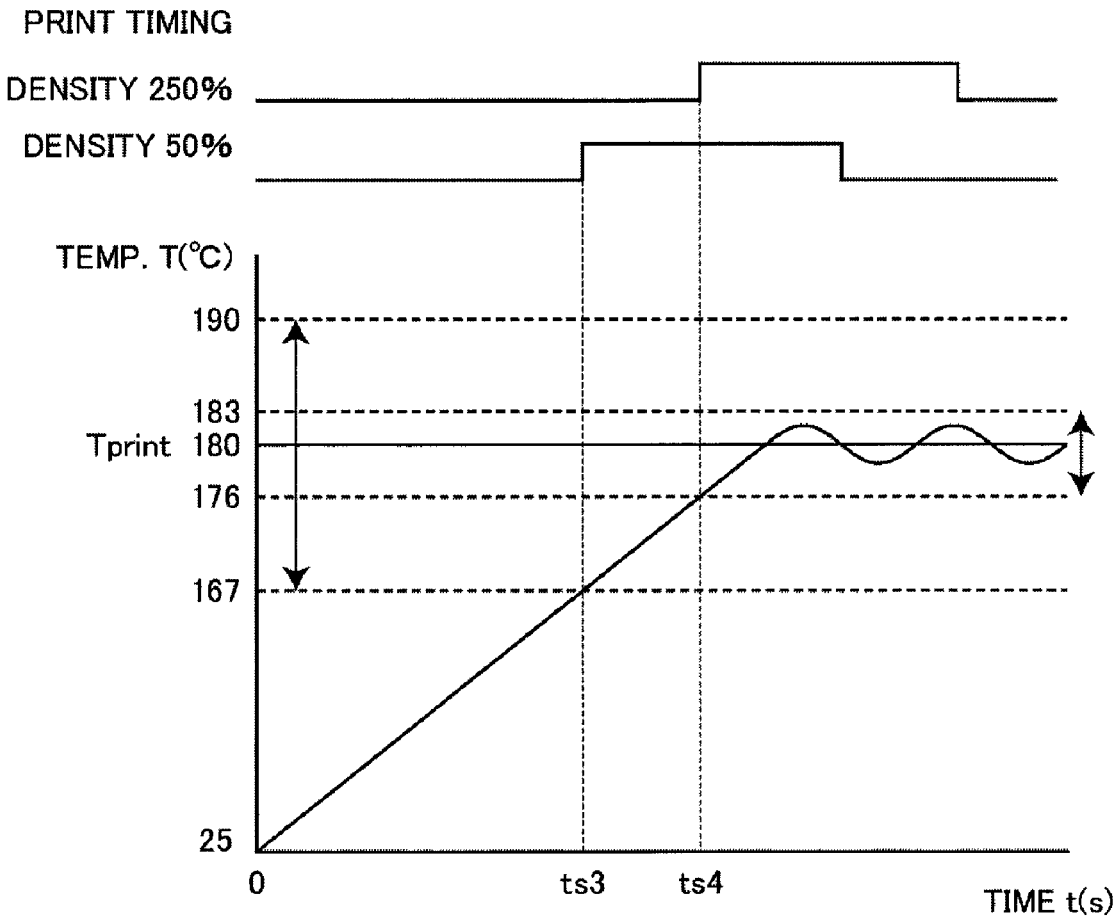
FIG. 7A is a schematic diagram illustrating a print startable timing.

Therefore, the print startable timing in the course of heating the fixing unit 112 can be adjusted according to the added image density in the first embodiment as illustrated in FIG. 7A. For example, where the added image density is fifty (50) percent, the printing operation is started at a time "ts3" at which the temperature of the fixing unit 112 reaches the lower limit temperature "Tlower" of one hundred sixty seven (167) degrees Celsius in the fixable temperature range. Where the rate of the heat temperature change is two-point-five degrees Celsius per second (2.5° C./sec), and where the added image density is of two hundred fifty (250) percents, the printing operation can be executed three-point-six (3.6) seconds ((176−167)/2.5) earlier than a time "ts4" at which the fixing unit 112 reaches the lower limit temperature "Tlower" of one hundred seventy six (176) degrees Celsius in the fixable temperature range. Double-headed arrows on a left side and a right side in FIG. 7A indicate the print startable temperature ranges in a case of the density of fifty (50) percent and two hundred fifty (250) percents, respectively.

Figure 7B:
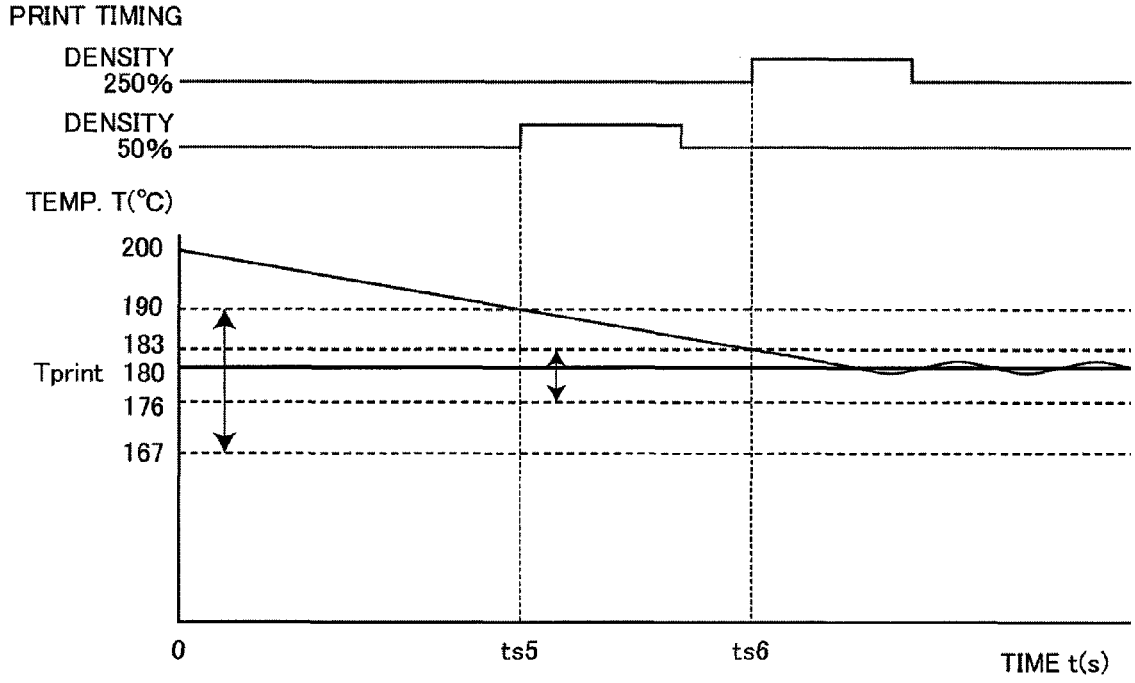
FIG. 7B is another schematic diagram illustrating a print startable timing.

Similarly, the print startable timing in the course of releasing the heat from the fixing unit 112 can be adjusted according to the added image density in the first embodiment as illustrated in FIG. 7B. For example, where the added image density is fifty (50) percent, the printing operation is started at a time "ts5" at which the temperature of the fixing unit 112 reaches the upper limit temperature "Tupper" of one hundred ninety (190) degrees Celsius in the fixable temperature range. Where the rate of the releasing temperature change is zero-point-two degrees Celsius per second (0.2° C./sec), and where the added image density of two hundred fifty (250) percents, the printing operation can be executed thirty five (35) seconds ((190−183)/0.2) earlier than a time "ts6" at which the fixing unit 112 reaches the upper limit temperature "Tupper" of one hundred eighty three (183) degrees Celsius in the fixable temperature range. Double-headed arrows on a left side and a right side in FIG. 7B indicate the print startable temperature ranges in a case of the density of fifty (50) percent and two hundred fifty (250) percents, respectively.

Figure 8:
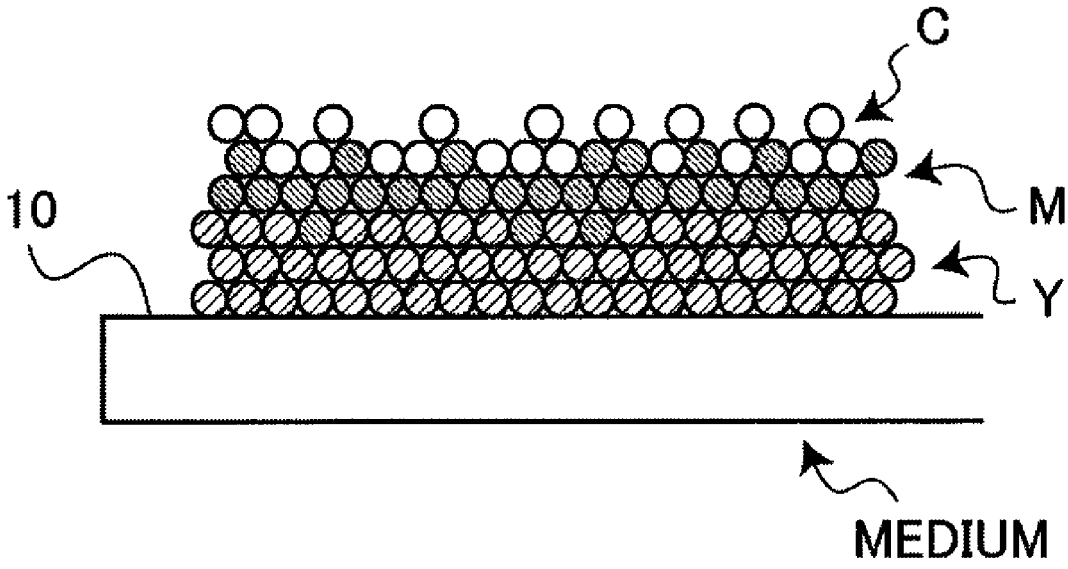
FIG. 8 is a schematic diagram illustrating a calculation method of image density information.

The image density information calculation unit 202 described above calculates the added image density based on the number of data dots per prescribed region of the print data received. Alternatively, the image density information calculation unit 202 can calculate the added image density by measuring a layer thickness of each of cyan, magenta and yellow colors of the developer on the sheet 10, for example, as illustrated in FIG. 8, and the fixable temperature range can be computed based on the added image density obtained.

Moreover, the fixing temperature range computing unit 204 described above refers to the fixable temperature range offset table as illustrated in FIG. 4 and computes the upper limit temperature "Tupper" and the lower limit temperature "Tlower" in the fixable temperature range. Alternatively, the fixing temperature range computing unit 204 can arrange, for example, fixing temperature offset values in maximum added image density and minimum added image density beforehand, and can determine the temperature of "Tupper" and "Tlower" by computation based on such two offset values. In such a case, since each developer has different fixability, a correction is made by a fixability coefficient provided to each color, thereby computing the temperature of "Tupper" and "Tlower" more accurately.

The sheet feeding mechanism control unit 209 described above allows the conveyance of the sheet 10 to be started in a case where the temperature of the fixing unit 112 reaches within the fixable temperature range. Alternatively, the sheet feeding mechanism control unit 209 can allow the conveyance of the sheet 10 to be started before the temperature of the fixing unit 112 reaches the fixable temperature range by controlling a number of rotations of the feed roller 103 and the like.

According to the first embodiment described above, in a case where the added image density of the print data is low, the fixable temperature range is increased, thereby advancing a print startable timing. Therefore, a waiting time of a fixing temperature adjustment in the fixing unit 112 can be shortened. Particularly, in a case where the temperature of the fixing unit 112 once increases to a high level, for example, after successive printing, the fixing unit 112 accumulates the heat therein, causing an increase in difficulty of decreasing the temperature thereof. In such a particular situation, the waiting time of the fixing temperature adjustment can be shortened. Moreover, in a case where the added image density of the print data is high, the fixable temperature range can be reduced, thereby obtaining stable fixability and enhancing fixing quality.

Second Embodiment

Elements and print operation of an image forming apparatus 2101 according to a second embodiment is similar to those of the image forming apparatus 101 described above in the first embodiment. Like elements will be given the same reference numerals as above, and description thereof will be omitted. In the second embodiment, a control program executable of the print operation of the image forming apparatus 2101 is different from the first embodiment.

Figure 9:
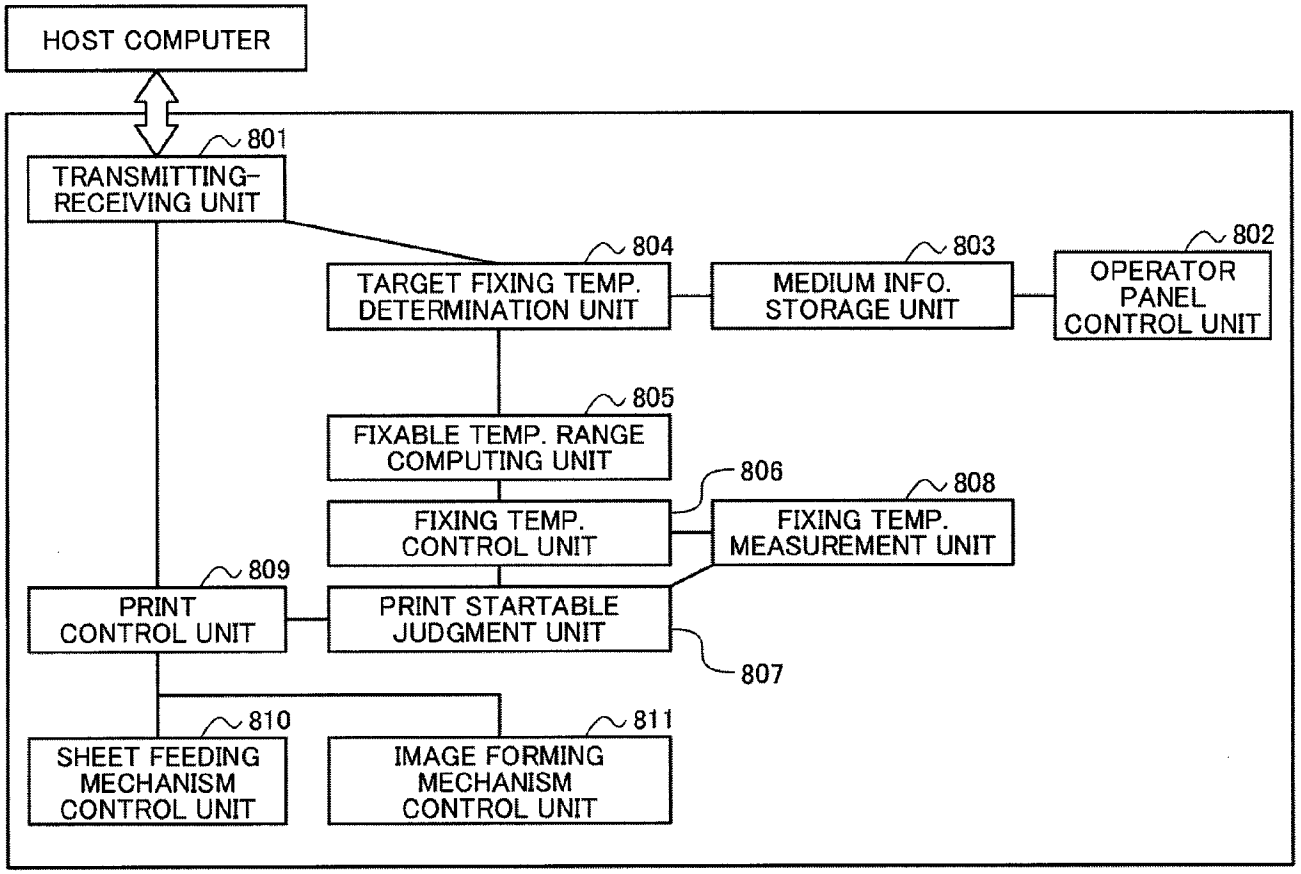
FIG. 9 is a block diagram illustrating a control program according to a second embodiment of the present invention.

Referring to FIG. 9, the control program executed by a central processing unit (CPU) according to the second embodiment is illustrated.

The control program includes: a transmitting-receiving unit 801 transmitting and receiving print data to and from a host computer and the like through an interface connector 125; an operator panel control unit 802 controlling an operator panel 124; a medium information storage unit 803 storing thickness information of a sheet 10, input by a user through the operator panel 124, in a nonvolatile memory 123; a target fixing temperature determination unit 804 determining fixing temperature arranged associated with the thickness information of the sheet 10 stored in the medium information storage unit 803 as target fixing temperature; a fixable temperature range computing unit 805 computing a fixing temperature range in which a developer image can be fixed onto the sheet 10 by using the thickness information of the sheet 10 while using the target fixing temperature as reference temperature; a fixing temperature control unit 806 controlling surface temperature of a heat roller 113 based on the fixable temperature range; a print startable judgment unit 807 judging whether or not to start the print operation based on the surface temperature of the heat roller 113; a fixing temperature measurement unit 808 acquiring a measurement result of the surface temperature of the heat roller 113 measured by a temperature sensor 115; a print control unit 809 controlling the print operation as a whole of the image forming apparatus 2101; a sheet feeding mechanism control unit 810 controlling feeding of the sheet 10; and an image forming mechanism control unit 811 controlling image formation and a transfer process.

The transmitting-receiving unit 801 transmits and receives print data to and from a host computer and the like through an interface connector 125. Upon receiving the print data, the transmitting-receiving unit 801 notifies the target fixing temperature determination unit 804 of reception of the print data.

The operator panel control unit 802 controls the operator panel 124 receiving the thickness information of the sheet 10 input by the user.

The medium information storage unit 803 stores the thickness information of the sheet 10 input through the operator panel 124 in the nonvolatile memory 123.

The target fixing temperature determination unit 804 reads the thickness information of the sheet 10 stored in the medium information storage unit 803, and determines the fixing temperature arranged associated with the thickness information of the sheet 10 as target fixing temperature (hereafter referred to as "Tprint"). In a case where an image to be formed on the sheet 10 is a multi-color image, three colors such as cyan, magenta, and yellow are used for general color expression. Since each maximum image density of the cyan, magenta, and yellow is one hundred (100) percent, added image density of the three colors becomes three hundred (300) percents.

However, each maximum image density of the three colors may be reduced to a value below one hundred (100) percent due to a problem of fixability, for example. Therefore, it must be noted that the added image density is not necessarily three hundred (300) percents.

In the second embodiment, the fixing temperature serving as the reference temperature is arranged beforehand according to the thickness of the sheet 10 to be used for the printing, so that a good printing result is obtained in a case where the printing operation is performed with the added image density of three hundred (300) percents. The target fixing temperature determination unit 804 determines the temperature of "Tprint" based on the thickness of the sheet 10 used for the printing. For example, where the thickness of the sheet 10 is one hundred (100) μm, the target fixing temperature determination unit 804 determines the temperature of "Tprint" to be one hundred seventy (170) degrees Celsius. Where the thickness of the sheet 10 is two hundred fifty (250) μm, the target fixing temperature determination unit 804 determines the temperature of "Tprint" to be one hundred eighty (180) degrees Celsius.

The fixable temperature range computation unit 805 computes the fixable temperature range in which the developer image can be fixed on the sheet 10 by using the thickness information of the sheet 10 while using the temperature of "Tprint" determined by the target temperature determination unit 804 as the reference temperature. Herein, the fixable temperature range includes upper limit temperature (hereafter referred to as "Tupper") and lower limit temperature (hereafter referred to as "Tlower").

Generally, a heat amount to be removed increases with an increase in the thickness of the sheet 10 to be used for the printing. Consequently, a temperature difference between the temperature of "Tprint" and "Tlower" may be arranged to be small while a temperature difference between the temperature of "Tprint" and "Tupper" can be arranged to be big so as to secure the fixability. Moreover, a heat amount to be removed decreases with a decrease in the thickness of the sheet 10 to be used for the printing. Consequently, the fixablity can be secured in a case where the temperature difference between the temperature of "Tprint" and "Tlower" is arranged to be big. However, in a case where the print data having high added image density are printed on the sheet 10 of a thin sheet, and in a case where the temperature of the heat roller 113 is high, the developer melted by the heat roller 113 sticks to the heat roller 113, causing winding the sheet 10 around the heat roller 113. Such a situation of winding the sheet 10 around the heat roller 113 may cause paper jam. Therefore, the temperature difference between the temperature of "Tprint" and "Tupper" needs to be small.

Based on such a condition, the fixable temperature range computing unit 805 computes the fixable temperature range. Particularly, the fixable temperature range computing unit 805 computes the fixable temperature range using a fixable temperature range offset table as illustrated in FIG. 10. For example, where the sheet 10 to be used for the printing has the thickness of one hundred (100) μm, and where the target fixing temperature determination unit 804 determines the temperature of "Tprint" to be one hundred seventy (170) degrees Celsius, the fixable temperature range computing unit 805 refers to the fixable temperature range offset table and computes the upper limit temperature "Tupper" to be one hundred seventy five (175) degrees Celsius ("Trpint" of 170° C.+an upper limit temperature offset value "Toff1" of 5° C.=175° C.) and the lower limit temperature "Tlower" to be one hundred sixty (160) degree Celsius ("Trpint" of 170° C.+a lower limit temperature offset value "Toff2" of −10° C.=160° C.). Moreover, where the sheet 10 to be used for the printing has the thickness of two hundred fifty (250) μm, and where the target fixing temperature determination unit 804 determines the temperature of "Tprint" to be one hundred eighty (180) degrees Celsius, the fixable temperature range computing unit 805 refers to the fixable temperature range offset table and computes the temperature of "Tupper" to be one hundred ninety two (192) degrees Celsius ("Trpint" of 180° C.+the upper limit temperature offset value "Toff1" of 12° C.=192° C.) and the temperature of "Tlower" to be one hundred seventy six (176) degree Celsius ("Trpint" of 180° C.+the lower limit temperature offset value "Toff2" of −4° C.=176° C.).

The fixing temperature control unit 806 controls the surface temperature of the heat roller 113 by turning on and off the halogen lamp 114 based on the fixable temperature range computed by the fixable temperature range computing unit 805.

The print starable judgment unit 807 judges whether or not to start the print operation based on a measurement result of the surface temperature of the heat roller 113.

The fixing temperature measurement unit 808 acquires, based on an instruction of the fixing temperature control unit 806 or the print startable judgment unit 807, the measurement result of the surface temperature of the heat roller 113 measured by the temperature sensor 115. The acquired surface temperature of the heat roller 113 is notified to the fixing temperature control unit 806 or the print startable judgment unit 807.

Where the print startable judgment unit 807 judges that the print operation is startable, the print control unit 809 controls the print operation of the image forming apparatus 2101 as a whole.

The sheet feeding mechanism control unit 810 controls the feeding of the sheet 10 fed by the feed roller 103 and the like based on the control by the print control unit 809.

The image forming mechanism control unit 811 controls the image formation provided by the image forming unit 108 and the transfer process provided by the transfer roller 111 and the like based on the control by the print control unit 809.

Figure 11:
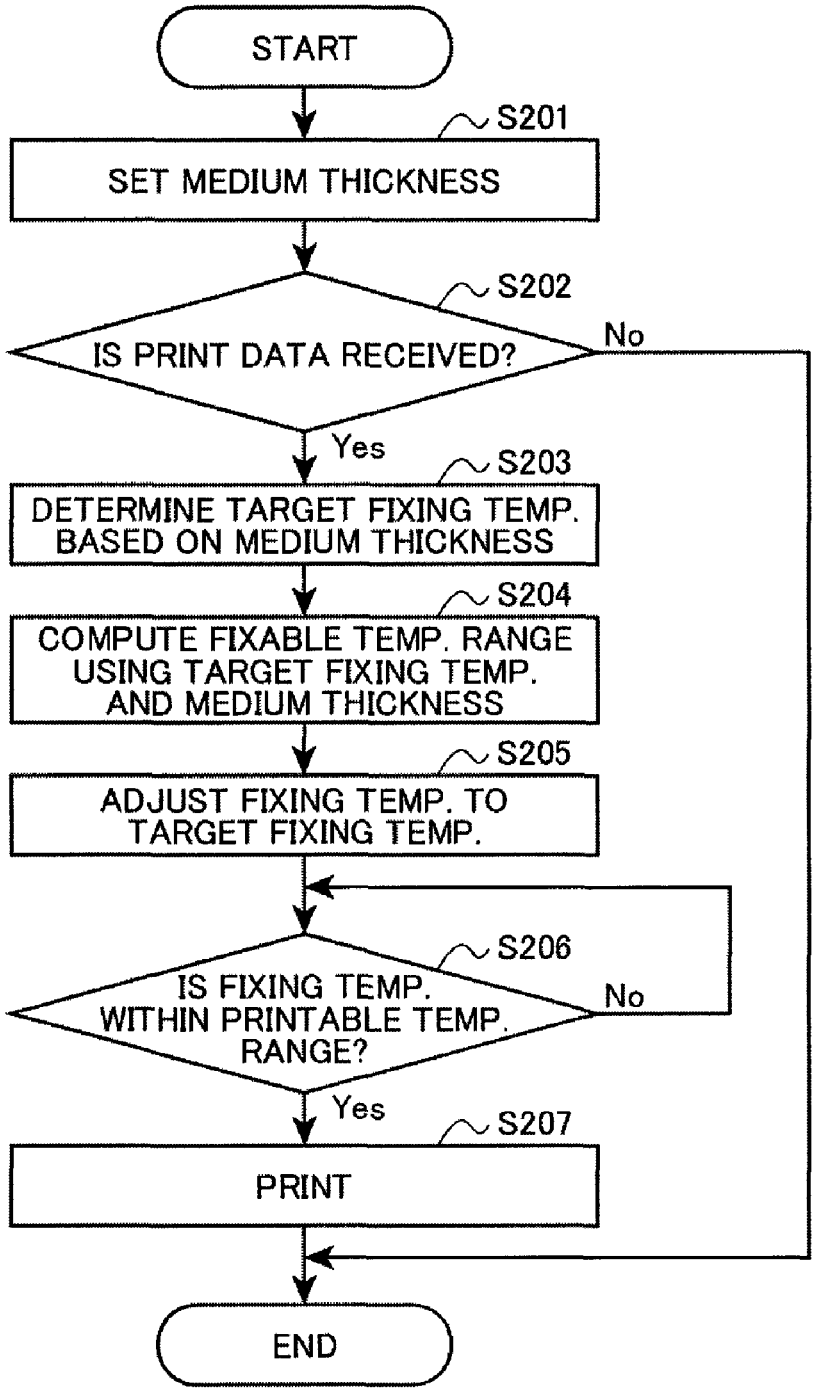
FIG. 11 is a flowchart illustrating an example procedure based on the control program.

Referring to a flowchart of FIG. 11, an example procedure based the control program described above is illustrated. In the second embodiment, the fixing temperature serving as the reference temperature is arranged beforehand according to the thickness of the sheet 10 to be used for the printing, so that a good printing result is obtained in a case where the printing operation is performed with the added image density of three hundred (300) percents.

The thickness information of the sheet 10 is input by the user through the operation panel 124. The operator panel control unit 802 notifies the medium information storage unit 803 of reception of the thickness information of the sheet 10. The medium information storage unit 803 stores the thickness information of the sheet 10 in the nonvolatile memory 123 (step S201).

Subsequently, when the print data is transmitted with respect to the image forming apparatus 2101 from the host computer, the transmitting-receiving unit 801 receives the print data through the interface connector 125. The transmitting-receiving unit 801 notifies of reception of the print data with respect to the target fixing temperature determination unit 804 (Yes in step S202).

Upon receiving the notification, the target fixing temperature determination unit 804 determines the temperature of "Tprint" based on the thickness information of the sheet 10 stored in the nonvolatile memory 123 (step S203).

Subsequently, the fixable temperature range computing unit 805 computes the temperature of "Tupper" and "Tlower" by using the thickness information of the sheet 10 while using the temperature of "Tprint" as the reference temperature (step S204).

In step S205, the fixing temperature control unit 806 supplies an instruction with respect to the fixing temperature measurement unit 808 to measure the surface temperature of the heat roller 113 by the temperature sensor 115. Where the surface temperature of the heat roller 113 is below "Tprint" as a result of measurement thereof by the temperature sensor 115, the fixing temperature control unit 806 supplies the instruction to a power source system (not shown) to distribute the power to the halogen lamp 114 such that the surface temperature of the heat roller 113 is adjusted to the temperature of "Tprint." Upon receiving the instruction from the fixing temperature control unit 806, the power source system begins the power distribution to the halogen lamp 114.

On the other hand, where the surface temperature of the heat roller 113 is above "Tprint" as a result of measurement thereof by the temperature sensor 115, the fixing temperature control unit 806 does not supply the power distribution instruction to the power source system (not shown).

After the surface temperature of the heat roller 113 reaches the temperature of "Tprint," the fixing temperature control unit 806 controls the power source system (not shown) such that the surface temperature of the heat roller 113 remains at the temperature of "Tprint."

Next, the print startable judgment unit 807 supplies the instruction with respect to the fixing temperature measurement unit 808 to measure the surface temperature of the heat roller 113 by the temperature sensor 115. Where the surface temperature of the heat roller 113 is within the fixable temperature range as a result of measurement thereof by the temperature sensor 115 (Yes in step S206), the print startable judgment unit 807 supplies a print start instruction to the print control unit 809. Upon receiving the print start instruction, the print control unit 809 supplies a print execution instructions to the sheet feeding mechanism control unit 810 and the image forming mechanism control unit 811. Upon receiving the print execution instruction from the print control unit 809, the sheet feeding mechanism control unit 810 allows the feed roller 103 and the like to start conveying the sheet 10. The image forming unit 108 and the transfer roller 111 instructed by the image forming mechanism control unit 811 form the developer image on the sheet 10 conveyed.

The fixing unit 112 fixes the developer image on the sheet 10. Subsequently, the sheet 10 having the developer image fixed thereon is guided along the conveyance path 118 and is conveyed to the ejection roller 120. The ejection roller 120 ejects the sheet 10 on the stacker 121 (step S207).

Where the surface temperature of the heat roller 113 is outside the fixable temperature range as a result of measurement thereof by the temperature sensor 115 (No in step S206), the print startable judgment unit 807 does not supply the print start instruction to the print control unit 809. The print startable judgment unit 807 is on standby until the surface temperature of the heat roller 113 reaches within the fixable temperature range. Where the surface temperature of the heat roller 113 reaches within the fixable temperature range, the print startable judgment unit 807 supplies the print start instruction to the print control unit 809.

The fixable temperature range computing unit 805 according to the second embodiment refers to the fixable temperature range offset table as illustrated in FIG. 10 and computes the fixable temperature range based on the thickness information of the sheet 10. For example, where the sheet 10 to be used for the printing has the thickness of one hundred (100) μm, and where the target fixing temperature determination unit 804 determines the temperature of "Tprint" to be one hundred seventy (170) degrees Celsius, the fixable temperature range computing unit 805 computes the temperature of "Tupper" to be one hundred seventy five (175) degrees Celsius and the temperature of "Tlower" to be one hundred sixty (160) degree Celsius (that is, the fixable temperature range is between 160° C. and 175° C.). Moreover, for example, where the sheet 10 to be used for the printing has the thickness of two hundred fifty (250) μm, and where the target fixing temperature determination unit 804 determines the temperature of "Tprint" to be one hundred eighty (180) degrees Celsius, the fixable temperature range computing unit 805 computes the temperature of "Tupper" to be one hundred ninety two (192) degrees Celsius and the temperature of "Tlower" to be one hundred seventy six (176) degree Celsius (that is, the fixable temperature range is between 176° C. and 192° C.).

Figure 12:
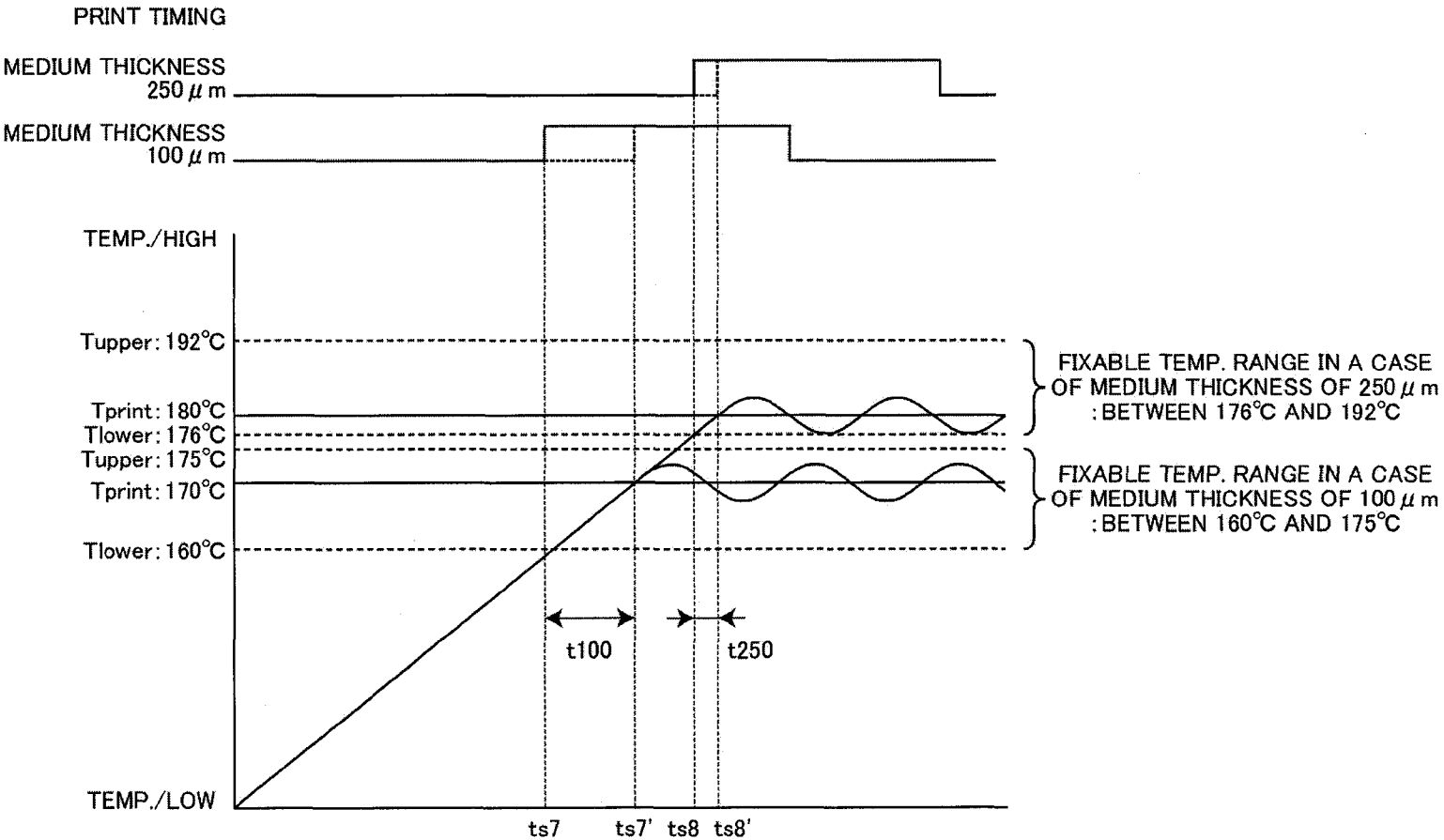
FIG. 12 is a schematic diagram illustrating a print startable timing.

Therefore, the print startable timing in the course of heating the fixing unit 112 can be adjusted according to the thickness of the sheet 10 in the second embodiment as illustrated in FIG. 12. For example, where the thickness of the sheet 10 is one hundred (100) μm, the printing operation is started at a time "ts7" at which the temperature of the fixing unit 112 reaches the lower limit temperature "Tlower" of one hundred sixty (160) degrees Celsius in the fixable temperature range. That is, where a rate of the heat temperature change is two-point-five degrees Celsius per second (2.5° C./sec), the printing operation can be started four (4) seconds ((170−160)/2.5) earlier than a time "ts7" at which the fixing unit 112 reaches the target temperature "Tprint" of one hundred seventy (170) degrees Celsius. Moreover, where the thickness of the sheet 10 is two hundred fifty (250) μm, the printing operation is started at a time "ts8" at which the temperature of the fixing unit 112 reaches the temperature of "Tlower" of one hundred seventy six (176) degrees Celsius. That is, where the rate of the heat temperature change is two-point-five degrees Celsius per second (2.5° C./sec), the printing operation can be started one-point-six (1.6) seconds ((180−176)/2.5) earlier than a time "ts8" at which the fixing unit 112 reaches the target temperature "Tprint" of one hundred eighty (180) degrees Celsius. Therefore, the thinner the sheet 10 in the course of heating, the more advantage the second embodiment can provide.

In FIG. 12, a dotted line led from the "Tupper" of 192° C., a solid line led from the "Tprint" of 180° C., a dotted line led from the "Tlower" of 176° C., a dotted line led from the "Tupper" of 175° C., a solid line led by the "Tprint" of 170° C., and a dotted line led by the "Tlower" of 160° C. indicate the fixable upper limit temperature in a case of the medium thickness of 250 μm, the target fixing temperature in a case of the medium thickness of 250 μm, the fixable lower limit temperature in a case of the medium thickness of 250 μm, the fixable upper limit temperature in a case of the medium thickness of 100 μm, the target fixing temperature in a case of the medium thickness of 100 μm, and the fixable lower limit temperature in a case of the medium thickness of 100 μm, respectively.

Figure 13:
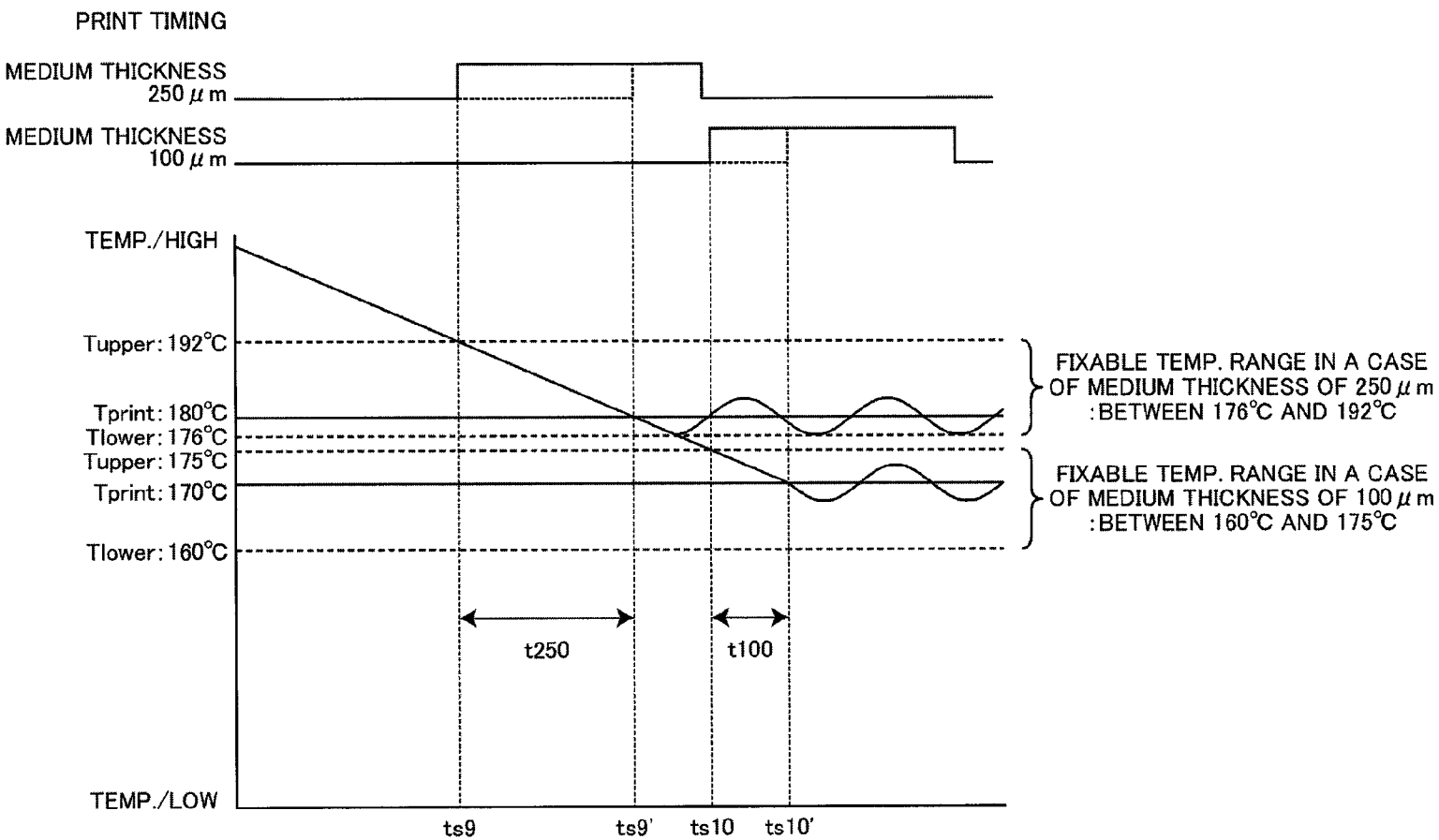
FIG. 13 is a schematic diagram illustrating a print startable timing.

Similarly, the print startable timing in the course of releasing the heat from the fixing unit 112 can be adjusted according to the thickness of the sheet 10 in the second embodiment as illustrated in FIG. 13. For example, where the thickness of the sheet 10 is two hundred fifty (250) μm, the printing operation is started at a time "ts9" at which the temperature of the fixing unit 112 reaches the upper limit temperature "Tupper" of one hundred ninety two (192) degrees Celsius in the fixable temperature range. That is, where the rate of the releasing temperature change is zero-point-five degrees Celsius per second (0.5° C./sec), the printing operation can be started twenty four (24) seconds ((192−180)/0.5) earlier than a time "ts9" at which the fixing unit 112 reaches the target temperature "Tprint" of one hundred eighty (180) degrees Celsius. Moreover, where the thickness of the sheet 10 is one hundred (100) μm, the printing operation is started at a time "ts10" at which the temperature of the fixing unit 112 reaches the temperature of "Tupper" of one hundred seventy five (175) degrees Celsius. That is, where the rate of the releasing temperature change is zero-point-five degrees Celsius per second (0.5° C./sec), the printing operation can be started ten (10) seconds ((175−170)/0.5) earlier than a time "ts10" at which the fixing unit 112 reaches the target temperature "Tprint" of one hundred seventy (170) degrees Celsius. Therefore, the thicker the sheet 10 in the course of releasing the heat, the more advantage the second embodiment can provide.

In FIG. 13, a dotted line led from the "Tupper" of 192° C., a solid line led from the "Tprint" of 180° C., a dotted line led from the "Tlower" of 176° C., a dotted line led from the "Tupper" of 175° C., a solid line led by the "Tprint" of 170° C., and a dotted line led by the "Tlower" of 160° C. indicate the fixable upper limit temperature in a case of the medium thickness of 250 μm, the target fixing temperature in a case of the medium thickness of 250 μm, the fixable lower limit temperature in a case of the medium thickness of 250 μm, the fixable upper limit temperature in a case of the medium thickness of 100 μm, the target fixing temperature in a case of the medium thickness of 100 μm, and the fixable lower limit temperature in a case of the medium thickness of 100 μm, respectively.

The fixing temperature range computing unit 805 described above refers to the fixable temperature range offset table as illustrated in FIG. 10 and computes the upper limit temperature "Tupper" and the lower limit temperature "Tlower." Alternatively, the fixing temperature range computing unit 805 can arrange, for example, fixing temperature offset values in maximum thickness and minimum thickness of the sheet 10 beforehand, and can determine the temperature of "Tupper" and "Tlower" by computation based on such two offset values.

The sheet feeding mechanism control unit 810 described above allows the conveyance of the sheet 10 to be started in a case where the temperature of the fixing unit 112 reaches within the fixable temperature range. Alternatively, the sheet feeding mechanism control unit 810 can allow the conveyance of the sheet 10 to be started before the temperature of the fixing unit 112 reaches the fixable temperature range by controlling a number of rotations of the feed roller 103 and the like.

According to the second embodiment described above, a print startable timing can be advanced based on the thickness information of the sheet 10. Therefore, a waiting time of a fixing temperature adjustment in the fixing unit 112 can be shortened. Particularly, in a case where the temperature of the fixing unit 112 once increases to a high level, for example, after successive printing, the fixing unit 112 accumulates the heat therein, causing an increase in difficulty of decreasing the temperature thereof. In such a situation, the waiting time of the fixing temperature adjustment can be shortened according to the second embodiment. Moreover, in a case where the sheet 10 is a thick sheet, the temperature difference between the temperature of "Tpirnt" and "Tlower" is arranged to be small, thereby obtaining stable fixability and enhancing fixing quality. Moreover, in a case where the sheet 10 is a thin sheet, the temperature difference between the temperature of "Tpirnt" and "Tupper" is arranged to be small, thereby reducing occurrences of the jam caused by winding the sheet 10 around the heat roller 113.

Third Embodiment

Elements and print operation of an image forming apparatus 3101 according to a third embodiment is similar to those of the image forming apparatus 101 described above in the first embodiment. Like elements will be given the same reference numerals as above, and description thereof will be omitted. In the third embodiment, a control program executable of the print operation of the image forming apparatus 3101 is different from the first embodiment.

Figure 14:
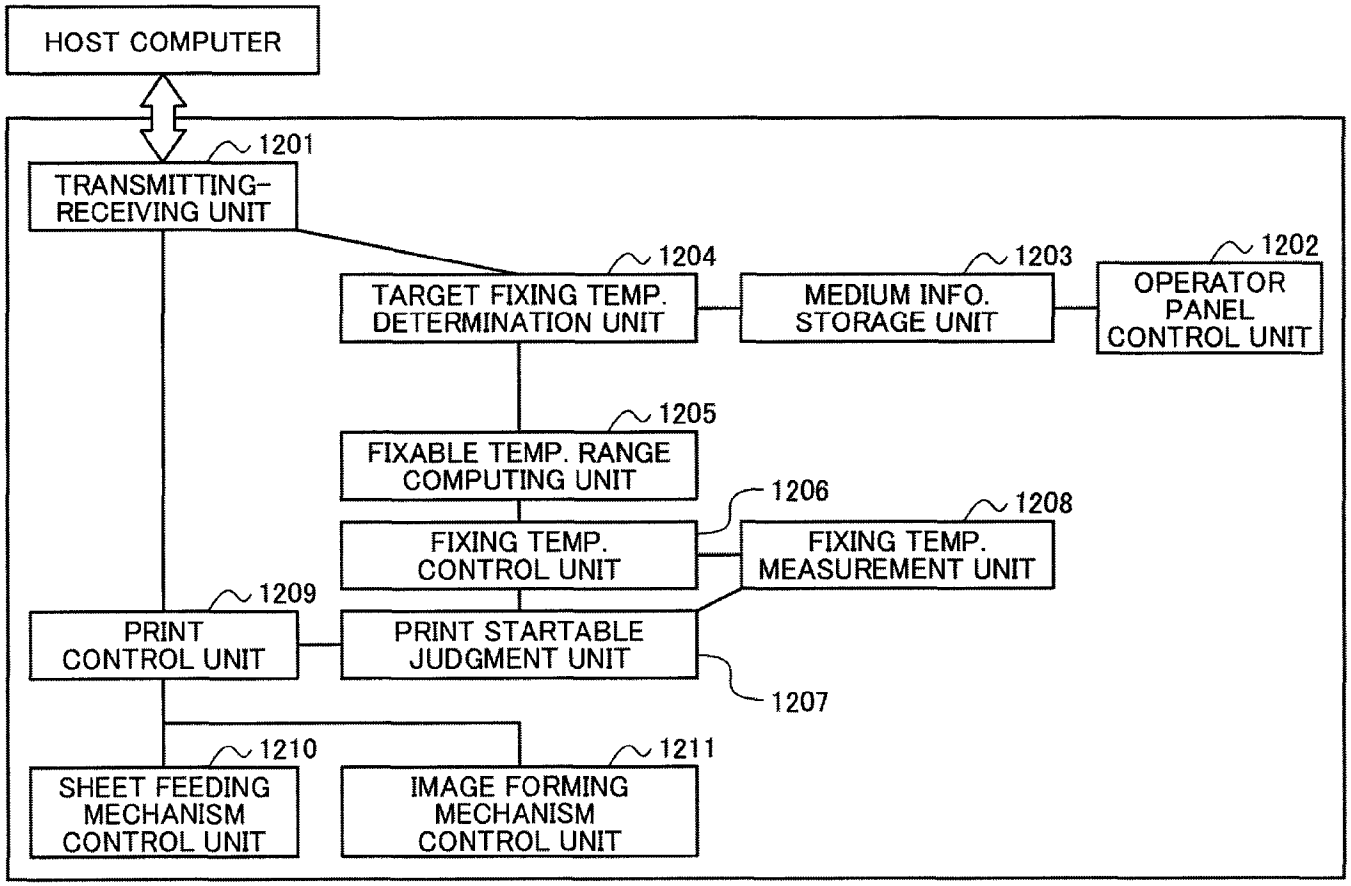
FIG. 14 is a block diagram illustrating a control program according to a third embodiment of the present invention.

Referring to FIG. 14, the control program executed by a central processing unit (CPU) according to the third embodiment is illustrated.

The control program includes: a transmitting-receiving unit 1201 transmitting and receiving print data to and from a host computer and the like through an interface connector 125; an operator panel control unit 1202 controlling an operator panel 124; a medium information storage unit 1203 storing class information of a sheet 10, input by a user through the operator panel 124, in a nonvolatile memory 123; a target fixing temperature determination unit 1204 determining fixing temperature arranged associated with the class information of the sheet 10 stored in the medium information storage unit 1203 as target fixing temperature; a fixable temperature range computing unit 1205 computing a fixable temperature range in which a developer image can be fixed onto the sheet 10 by using the class information of the sheet 10 while using the target fixing temperature as reference temperature; a fixing temperature control unit 1206 controlling surface temperature of a heat roller 113 based on the fixable temperature range; a print startable judgment unit 1207 judging whether or not to start the print operation based on the surface temperature of the heat roller 113; a fixing temperature measurement unit 1208 acquiring a measurement result of the surface temperature of the heat roller 113 measured by a temperature sensor 115; a print control unit 1209 controlling the print operation as a whole of the image forming apparatus 3101; a sheet feeding mechanism control unit 1210 controlling feeding of the sheet 10; and an image forming mechanism control unit 1211 controlling image formation and a transfer process.

The transmitting-receiving unit 1201 transmits and receives print data to and from a host computer and the like through an interface connector 125. Upon receiving the print data, the transmitting-receiving unit 1201 notifies the target fixing temperature determination unit 1204 of reception of the print data.

The operator panel control unit 1202 controls the operator panel 124 receiving the class information of the sheet 10 input by the user.

The medium information storage unit 1203 stores the class information of the sheet 10 input through the operator panel 124 in the nonvolatile memory 123.

The target fixing temperature determination unit 1204 reads the class information of the sheet 10 stored in the medium information storage unit 1203, and determines the fixing temperature arranged associated with the class information of the sheet 10 as target fixing temperature (hereafter referred to as "Tprint"). In a case where an image to be formed on the sheet 10 is a multi-color image, three colors such as cyan, magenta, and yellow are used for general color expression. Since each maximum image density of the cyan, magenta, and yellow is one hundred (100) percent, added image density of the three colors becomes three hundred (300) percents.

However, each maximum image density of the three colors may be reduced to a value below one hundred (100) percent due to a problem of fixability, for example. Therefore, it must be noted that the added image density is not necessarily three hundred (300) percents.

In the third embodiment, the fixing temperature serving as the reference temperature is arranged beforehand according to the class of the sheet 10 to be used for the printing, so that a good printing result is obtained in a case where the printing operation is performed with the added image density of three hundred (300) percents. The target fixing temperature determination unit 1204 determines the temperature of "Tprint" based on the class of the sheet 10 used for the printing. For example, where the sheet 10 is a plain sheet, the target fixing temperature determination unit 1204 determines the temperature of "Tprint" to be one hundred eighty (180) degrees Celsius.

The fixable temperature range computation unit 1205 computes the fixable temperature range in which the developer image can be fixed on the sheet 10 by using the class information of the sheet 10 while using the temperature of "Tprint" determined by the target temperature determination unit 1204 as the reference temperature. Herein, the fixable temperature range includes upper limit temperature (hereafter referred to as "Tupper") and lower limit temperature (hereafter referred to as "Tlower").

Generally, a heat amount to be removed varies depending on the class (e.g., the plain sheet, a glossy sheet, a label sheet, a postcard, an envelope, an OHP sheet) of the sheet 10 to be used for the printing. In this regard, a temperature offset value needs to be arranged beforehand to obtain a good fixability with respect to each class of the sheet 10. Therefore, the fixable temperature range computing unit 1205 computes the fixable temperature range using a fixable temperature range offset table as illustrated in FIG. 15. For example, where the sheet 10 to be used for the printing operation is the plain sheet, and where the target fixing temperature determination unit 1204 determines the temperature of "Tprint" to be one hundred eighty (180) degrees Celsius, the fixable temperature range computing unit 1205 computes the temperature of "Tupper" to be one hundred ninety (190) degrees Celsius ("Trpint" of 180° C.+an upper limit temperature offset value "Toff1" of 10° C.=190° C.) and the temperature of "Tlower" to be one hundred sixty seven (167) degrees Celsius ("Trpint" of 180° C.+a lower limit temperature offset value "Toff2" of −13° C.=167° C.). For example, where the sheet 10 to be used for the printing operation is the glossy sheet, and where the target fixing temperature determination unit 1204 determines the temperature of "Tprint" to be one hundred eighty (180) degrees Celsius, the fixable temperature range computing unit 1205 refers to the fixable temperature range offset table and computes the temperature of "Tupper" to be one hundred eighty five (185) degrees Celsius ("Trpint" of 180° C.+the upper limit temperature offset value "Toff1" of 5° C.=1185° C.) and the temperature of "Tlower" to be one hundred seventy four (174) degrees Celsius ("Trpint" of 180° C.+the lower limit temperature offset value "Toff2" of −6° C.=174° C.).

The fixing temperature control unit 1206 controls the surface temperature of the heat roller 113 by turning on and off the halogen lamp 114 based on the fixable temperature range computed by the fixable temperature range computing unit 1205.

The print starable judgment unit 1207 judges whether or not to start the print operation based on a measurement result of the surface temperature of the heat roller 113.

The fixing temperature measurement unit 1208 acquires, based on an instruction of the fixing temperature control unit 1206 or the print startable judgment unit 1207, the measurement result of the surface temperature of the heat roller 113 measured by the temperature sensor 115. The acquired surface temperature of the heat roller 113 is notified to the fixing temperature control unit 1206 or the print startable judgment unit 1207.

Where the print startable judgment unit 1207 judges that the print operation is startable, the print control unit 1209 controls the print operation of the image forming apparatus 3101 as a whole.

The sheet feeding mechanism control unit 1210 controls the feeding of the sheet 10 fed by the feed roller 103 and the like based on the control by the print control unit 1209.

The image forming mechanism control unit 1211 controls the image formation provided by the image forming unit 108 and the transfer process provided by the transfer roller 111 and the like based on the control by the print control unit 1209.

Figure 16:
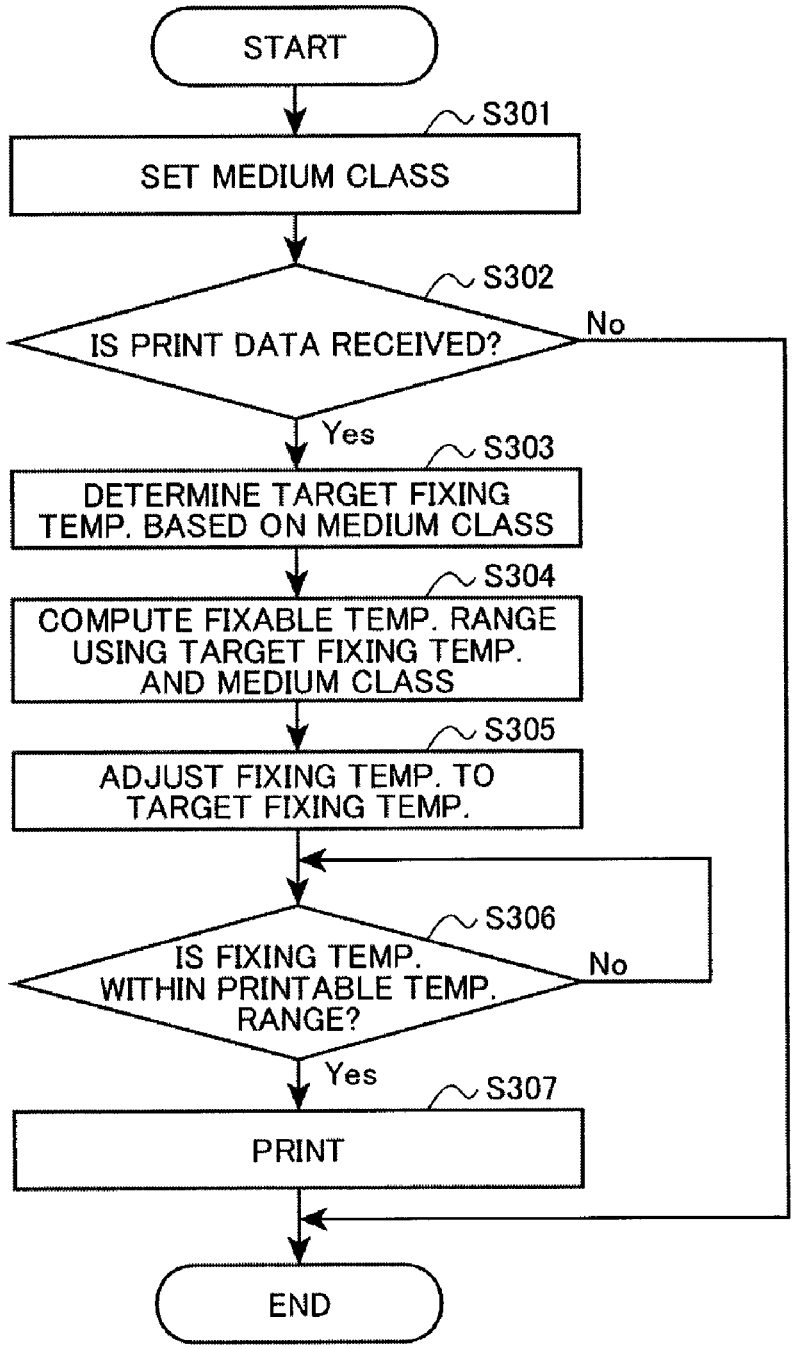
FIG. 16 is a flowchart illustrating an example procedure based on the control program.

Referring to a flowchart of FIG. 16, an example procedure based the control program described above is illustrated. In the third embodiment, the fixing temperature serving as the reference temperature is arranged beforehand according to the class of the sheet 10 to be used for the printing, so that a good printing result is obtained in a case where the printing operation is performed with the added image density of three hundred (300) percents.

The class information of the sheet 10 is input by the user through the operation panel 124. The operator panel control unit 1202 notifies the medium information storage unit 1203 of reception of the class information of the sheet 10. The medium information storage unit 1203 stores the class information of the sheet 10 in the nonvolatile memory 123 (step S301).

Subsequently, when the print data are transmitted with respect to the image forming apparatus 3101 from the host computer, the transmitting-receiving unit 1201 receives the print data through the interface connector 125. The transmitting-receiving unit 1201 notifies of reception of the print data with respect to the target fixing temperature determination unit 1204 (Yes in step S302).

Upon receiving the notification, the target fixing temperature determination unit 1204 determines the temperature of "Tprint" based on the class information of the sheet 10 stored in the nonvolatile memory 123 (step S303).

Subsequently, the fixable temperature range computing unit 1205 computes the temperature of "Tupper" and "Tlower" by using the class information of the sheet 10 while using the temperature of"Tprint" as the reference temperature (step S304).

In step S305, the fixing temperature control unit 1206 supplies an instruction with respect to the fixing temperature measurement unit 1208 to measure the surface temperature of the heat roller 113 by the temperature sensor 115. Where the surface temperature of the heat roller 113 is below "Tprint" as a result of measurement thereof by the temperature sensor 115, the fixing temperature control unit 1206 supplies the instruction to a power source system (not shown) to distribute the power to the halogen lamp 114 such that the surface temperature of the heat roller 113 is adjusted to the temperature of "Tprint." Upon receiving the instruction from the fixing temperature control unit 1206, the power source system begins the power distribution to the halogen lamp 114.

On the other hand, where the surface temperature of the heat roller 113 is above "Tprint" as a result of measurement thereof by the temperature sensor 115, the fixing temperature control unit 1206 does not supply the power distribution instruction to the power source system (not shown).

After the surface temperature of the heat roller 113 reaches the temperature of "Tprint," the fixing temperature control unit 1206 controls the power source system (not shown) such that the surface temperature of the heat roller 113 remains at the temperature of "Tprint."

Next, the print startable judgment unit 1207 supplies the instruction with respect to the fixing temperature measurement unit 1208 to measure the surface temperature of the heat roller 113 by the temperature sensor 115. Where the surface temperature of the heat roller 113 is within the fixable temperature range as a result of measurement thereof by the temperature sensor 115 (Yes in step S306), the print startable judgment unit 1207 supplies a print start instruction to the print control unit 1209. Upon receiving the print start instruction, the print control unit 1209 supplies a print execution instructions to the sheet feeding mechanism control unit 1210 and the image forming mechanism control unit 1211. Upon receiving the print execution instruction from the print control unit 1209, the sheet feeding mechanism control unit 1210 allows the feed roller 103 and the like to start conveying the sheet 10. The image forming unit 108 and the transfer roller 111 instructed by the image forming mechanism control unit 1211 form the developer image on the sheet 10 conveyed.

The fixing unit 112 fixes the developer image on the sheet 10. The sheet 10 having the developer image fixed thereon is guided along the conveyance path 118 and is conveyed to the ejection roller 120. The ejection roller 120 ejects the sheet 10 on the stacker 121 (step S307).

Where the surface temperature of the heat roller 113 is outside the fixable temperature range as a result of measurement thereof by the temperature sensor 115 (No in step S306), the print startable judgment unit 1207 does not supply the print start instruction to the print control unit 1209. The print startable judgment unit 1207 is on standby until the surface temperature of the heat roller 113 reaches within the fixable temperature range. Where the surface temperature of the heat roller 113 reaches within the fixable temperature range, the print startable judgment unit 1207 supplies the print start instruction to the print control unit 1209.

The fixable temperature range computing unit 1205 according to the third embodiment refers to the fixable temperature range offset table as illustrated in FIG. 15 and computes the fixable temperature range based on the class information of the sheet 10. For example, where the sheet 10 to be used for the printing operation is the plain sheet, and where the target fixing temperature determination unit 1204 determines the temperature of "Tprint" to be one hundred eighty (180) degrees Celsius, the fixable temperature range computing unit 1205 computes the temperature of "Tupper" to be one hundred ninety (190) degrees Celsius and the temperature of "Tlower" to be one hundred sixty seven (167) degree Celsius (that is, the fixable temperature range is between 167° C. and 190° C.). Moreover, for example, where the sheet 10 to be used for the printing operation is the glossy sheet, and where the target fixing temperature determination unit 1204 determines the temperature of "Tprint" to be one hundred eighty (180) degrees Celsius, the fixable temperature range computing unit 1205 computes the temperature of "Tupper" to be one hundred eighty five (185) degrees Celsius and the temperature of "Tlower" to be one hundred seventy four (174) degree Celsius (that is, the fixable temperature range is between 174° C. and 185° C.).

Figure 17:
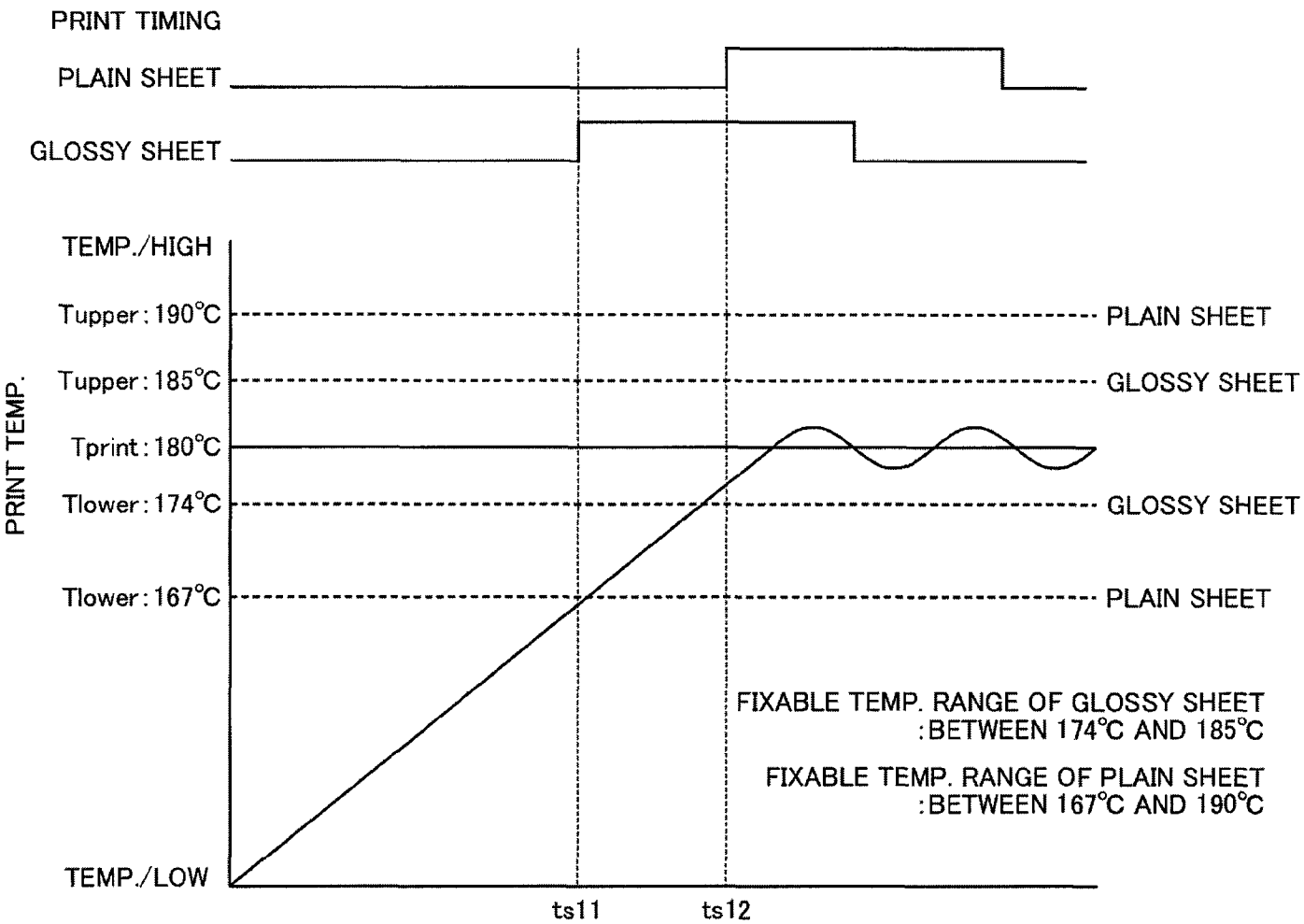
FIG. 17 is a schematic diagram illustrating a print startable timing.

Therefore, the print startable timing in the course of heating the fixing unit 112 can be adjusted according to the class of the sheet 10 in the third embodiment as illustrated in FIG. 17. For example, where the sheet 10 is the plain sheet, the printing operation is started at a time "ts11" at which the temperature of the fixing unit 112 reaches the lower limit temperature "Tlower" of one hundred sixty seven (167) degrees Celsius in the fixable temperature range. Where a rate of the heat temperature change is two-point-five degrees Celsius per second (2.5° C./sec), and where the sheet 10 is the glossy sheet, the printing operation can be executed two-point-eight (2.8) seconds ((174−167)/2.5) earlier than a time "ts12" at which the fixing unit 112 reaches the lower limit temperature "Tlower" of one hundred seventy four (174) degrees Celsius.

In FIG. 17, a dotted line led from the "Tupper" of 190° C., a dotted line led from the "Tupper" of 185° C., a solid line led from the "Tprint" of 180° C., a dotted line led from the "Tlower" of 174° C., and a dotted line led from the "Tlower" of 167° C. indicate the fixable upper limit temperature in a case of the plain sheet, the fixable upper limit temperature in a case of the glossy sheet, the fixable lower limit temperature in a case of the glossy sheet, and the fixable lower limit temperature in a case of the plain sheet, respectively.

Figure 18:
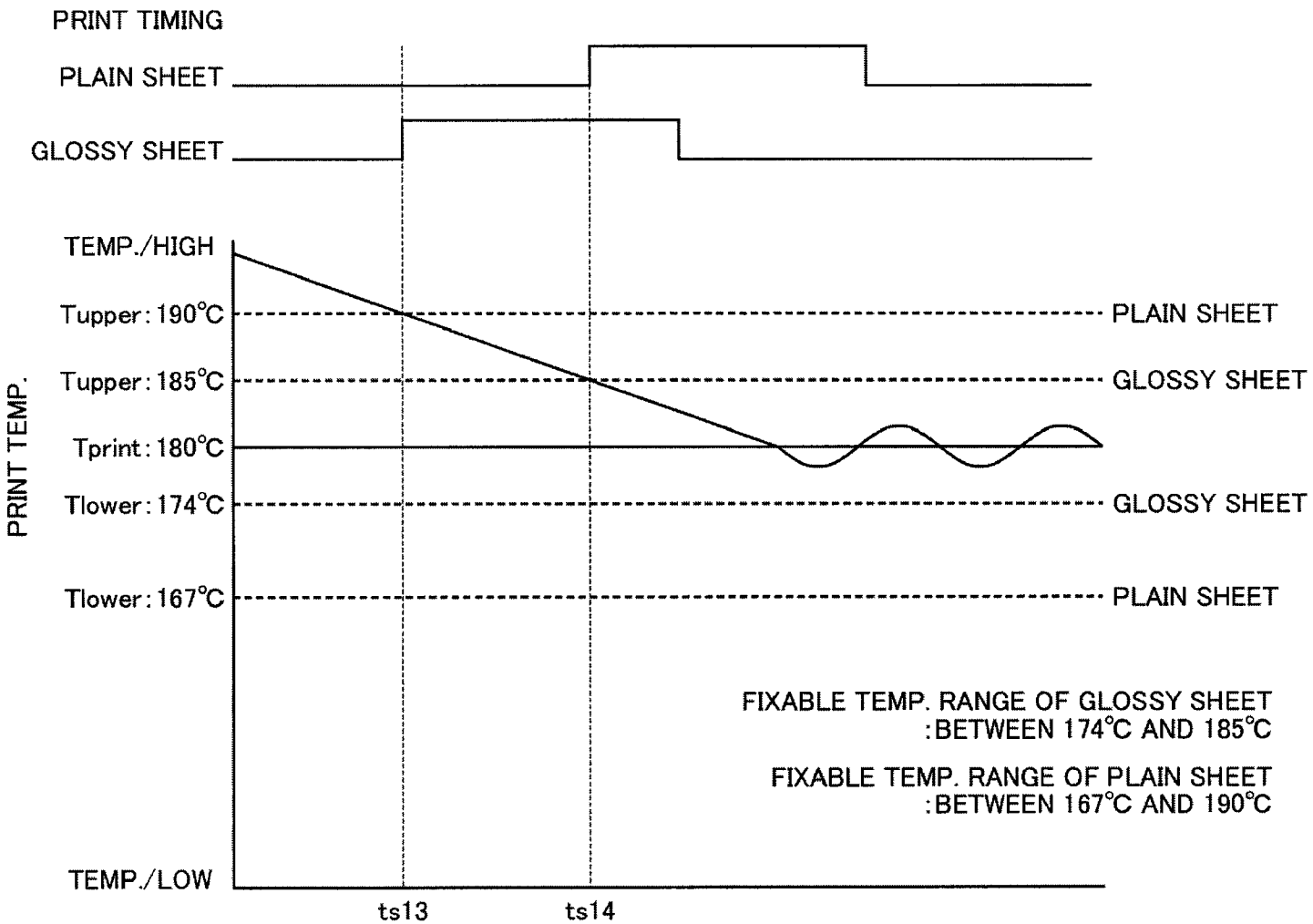
FIG. 18 is another schematic diagram illustrating a print startable timing.

Similarly, the print startable timing in the course of releasing the heat from the fixing unit 112 can be adjusted according to the class of the sheet 10 in the third embodiment as illustrated in FIG. 18. For example, where the sheet 10 is the plain sheet, the printing operation is started at a time "ts13" at which the temperature of the fixing unit 112 reaches the upper limit temperature "Tupper" of one hundred ninety (190) degrees Celsius in the fixable temperature range. Where the rate of the releasing temperature change is zero-point-two degrees Celsius per second (0.2° C./sec), and where the sheet 10 is the glossy sheet, the printing operation can be executed twenty five (25) seconds ((190−185)/0.2) earlier than a time "ts14" at which the fixing unit 112 reaches the upper limit temperature "Tupper" of one hundred eighty five (185) degrees Celsius.

In FIG. 18, a dotted line led from the "Tupper" of 190° C., a dotted line led from the "Tupper" of 185° C., a solid line led from the "Tprint" of 180° C., a dotted line led from the "Tlower" of 174° C., and a dotted line led from the "Tlower" of 167° C. indicate the fixable upper limit temperature in a case of the plain sheet, the fixable upper limit temperature in a case of the glossy sheet, the fixable lower limit temperature in a case of the glossy sheet, and the fixable lower limit temperature in a case of the plain sheet, respectively.

The sheet feeding mechanism control unit 1210 according to the third embodiment allows the conveyance of the sheet 10 to be started in a case where the temperature of the fixing unit 112 reaches within the fixable temperature range. Alternatively, the sheet feeding mechanism control unit 1210 can allow the conveyance of the sheet 10 to be started before the temperature of the fixing unit 112 reaches the fixable temperature range by controlling a number of rotations of the feed roller 103 and the like.

According to the third embodiment described above, a print startable timing can be advanced based on the class information of the sheet 10. Therefore, a waiting time of a fixing temperature adjustment in the fixing unit 112 can be shortened. Particularly, in a case where the temperature of the fixing unit 112 once increases to a high level, for example, after successive printing, the fixing unit 112 accumulates the heat therein, causing an increase in difficulty of decreasing the temperature thereof. In such a situation, the waiting time of the fixing temperature adjustment can be shortened according to the third embodiment. Moreover, in a case where the sheet 10 is a special medium such as the glossy sheet and the label sheet, a fluctuation range of the fixing temperature can be reduced by narrowing the fixable temperature range, thereby enhancing the printing quality.

According to the first, second, and third embodiment, the image forming apparatuses 101, 2101, and 3101 capable of forming the multi-color image by the developer of plural colors are described above. However, an image forming apparatus capable of forming a monochrome image by the developer of a single color can control as similar to the above embodiments. The present invention can be applied to a facsimile machine, a multifunctional peripheral, a photocopier, and the like. In the embodiments described above, print setting including medium information input by the user is received through the operator panel 124. Alternatively, the print setting including the medium information can be performed in the host computer.

The present invention has been described above with regard to particular embodiments, but the present invention is not limited thereto. As can be appreciated by those skilled in the art, numerous additional modifications and variation of the present invention are possible in light of the above-described teachings. It is therefore to be understood that, within the scope of the appended claims, the disclosure of this patent specification may be practiced otherwise than as specifically described herein.

What is claimed is:

1. An image forming apparatus comprising a fixing unit fixing a developer image formed based on received image data onto a medium, the image forming apparatus comprising:

a target fixing temperature determination unit determining fixing temperature arranged based on the medium as target fixing temperature;

a fixable temperature range computing unit computing a fixable temperature range to fix the developer image on the medium by using one or more temperature offset values selected based on medium information and the target fixing temperature; and a fixing temperature control unit controlling the fixing unit based on the fixable temperature range computed by the fixable temperature range computing unit, wherein the fixable temperature range includes the target fixing temperature, and the fixing temperature control unit starts to print when the temperature of the fixing unit is in the fixable temperature range and controls the temperature of the fixing unit such that the target fixing temperature is maintained, wherein the one or more temperature offset values differ according to the medium information.

2. The image forming apparatus according to claim 1, wherein the medium information is image density information based on a number of dots per prescribed region of the image data.

3. The image forming apparatus according to claim 1, wherein the medium information is image density information based on thickness of a developer layer per prescribed region of the image data.

4. The image forming apparatus according to claim 1 further comprising a medium information input unit receiving an input of the medium information of the medium.

5. The image forming apparatus according to claim 1, wherein the medium information is thickness information of the medium.

6. The image forming apparatus according to claim 1, wherein the medium information is class information of the medium.

7. The image forming apparatus according to claim 1, wherein the medium information includes added image density, and in a case where the added image density is high, the fixable temperature range is narrower than the range of a case where the added image density is low.

8. The image forming apparatus according to claim 1, wherein the medium information includes added image density, wherein the added image density is calculated by measuring layer thickness of each color.

9. The image forming apparatus according to claim 1, wherein the medium information includes maximum added image density and minimum added image density.

10. The image forming apparatus according to claim 1, wherein the medium information includes added image density, and a fixability coefficient differs for each color, and the added image density is amended according to the fixability coefficient.

11. The image forming apparatus according to claim 1, wherein the medium information includes a medium thickness, in a case where the medium is a thick sheet, a hot temperature offset value is larger than a cold temperature offset value.

12. The image forming apparatus according to claim 1, wherein the medium information includes a medium thickness, in a case where the medium is a thin sheet, a cold temperature offset value is larger than a hot temperature offset value.

13. The image forming apparatus according to claim 1, wherein the medium information includes a maximum thickness of the medium and a minimum thickness of the medium.

14. The image forming apparatus according to claim 1, wherein a hot temperature offset value and a cold temperature offset value are substantially the same for every medium class.

15. The image forming apparatus according to claim 1, wherein a fixable temperature range of an OHP sheet is narrower than other medium classes.

16. An image forming system comprising:

an image processing apparatus processing image data; and an image forming apparatus comprising a fixing unit fixing a developer image formed based on the image data received from the image processing apparatus onto a medium, the image forming apparatus comprising:

a communication unit communicating with the image processing apparatus;

a target fixing temperature determination unit determining fixing temperature arranged based on the medium as target fixing temperature;

a fixable temperature range computing unit computing a fixable temperature range to fix the developer image on the medium by using one or more temperature offset values selected based on medium information and the target fixing temperature; and a fixing temperature control unit controlling the fixing unit based on the fixable temperature range computed by the fixable temperature range computing unit, wherein the fixable temperature range includes the target fixing temperature, and the fixing temperature control unit starts to print when the temperature of the fixing unit is in the fixable temperature range and controls the temperature of the fixing unit such that the target fixing temperature is maintained, wherein the one or more temperature offset values differ according to the medium information.

17. The image forming system according to claim 16, wherein the medium information is image density information based on a number of dots per prescribed region of the image data.

18. The image forming system according to claim 16, wherein the medium information is image density information based on thickness of a developer layer per prescribed region of the image data.

19. The image forming system according to claim 16 further comprising a medium information input unit receiving an input of the medium information of the medium.

20. The image forming system according to claim 16, wherein the medium information is thickness information of the medium.

21. The image forming system according to claim 16, wherein the medium information is class information of the medium.

22. The image forming apparatus according to claim 16, wherein the medium information includes added image density, and in a case where the added image density is high, the fixable temperature range is narrower than the range of a case where the added image density is low.

23. The image forming apparatus according to claim 16, wherein the medium information includes added image density, wherein the added image density is calculated by measuring layer thickness of each color.

24. The image forming apparatus according to claim 16, wherein the medium information includes maximum added image density and minimum added image density.

25. The image forming apparatus according to claim 16, wherein the medium information includes added image density, and a fixability coefficient differs for each color, and the added image density is amended according to the fixability coefficient.

26. The image forming apparatus according to claim 16, wherein the medium information includes a medium thickness, in a case where the medium is a thick sheet, a hot temperature offset value is larger than a cold temperature offset value.

27. The image forming apparatus according to claim 16, wherein the medium information includes a medium thickness, in a case where the medium is a thin sheet, a cold temperature offset value is larger than a hot temperature offset value.

28. The image forming apparatus according to claim 16, wherein the medium information includes a maximum thickness of the medium and a minimum thickness of the medium.

29. The image forming apparatus according to claim 16, wherein a hot temperature offset value and a cold temperature offset value are substantially the same for every medium class.

30. The image forming apparatus according to claim 16, wherein a fixable temperature range of an OHP sheet is narrower than other medium classes.

* * * * *